US009765267B2

(12) United States Patent
Evans et al.

(10) Patent No.: US 9,765,267 B2
(45) Date of Patent: Sep. 19, 2017

(54) METHODS AND SYSTEMS FOR TREATING A HYDROCARBON FEED

(71) Applicant: ExxonMobil Chemical Patents Inc., Baytown, TX (US)

(72) Inventors: Christopher M. Evans, Houston, TX (US); Jeevan S. Abichandani, Houston, TX (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 0 days.

(21) Appl. No.: 14/945,990

(22) Filed: Nov. 19, 2015

(65) Prior Publication Data

US 2016/0177205 A1 Jun. 23, 2016

Related U.S. Application Data

(60) Provisional application No. 62/093,000, filed on Dec. 17, 2014.

(30) Foreign Application Priority Data

Apr. 3, 2015 (EP) ..... 15248031

(51) Int. Cl.
*C10G 31/06* (2006.01)
*C10G 69/02* (2006.01)
(Continued)

(52) U.S. Cl.
CPC ..... *C10G 69/02* (2013.01); *C10G 9/36* (2013.01); *C10G 31/06* (2013.01); *C10G 47/02* (2013.01); *C10G 2300/1096* (2013.01); *C10G 2300/202* (2013.01); *C10G 2300/301* (2013.01); *C10G 2300/302* (2013.01); *C10G 2300/308* (2013.01); *C10G 2300/4012* (2013.01); *C10G 2300/4056* (2013.01)

(58) Field of Classification Search
CPC ..... C10G 69/00; C10G 69/02; C10G 31/06; C10G 47/02; C10G 9/36
See application file for complete search history.

(56) References Cited

U.S. PATENT DOCUMENTS 2,382,260 A 8/1945 Schaad
2,382,269 A 8/1945 Stephens et al.
(Continued)

FOREIGN PATENT DOCUMENTS

CA 2314033 1/2001
CA 2579528 3/2006
(Continued)

OTHER PUBLICATIONS

Khuong, K. et al."The Mechanism of the Self-Initiated Thermal Polymerization of Styrene. Theoretical Solution of a Classic Problem", J. AM. CHEM. SOC. 2005, 127, pp. 1265-1277.
(Continued)

*Primary Examiner* — Brian McCaig
(74) *Attorney, Agent, or Firm* — Brandon J. Hindmarsh

(57) ABSTRACT

The invention relates to methods and systems for treating heavy hydrocarbon by cavitation and hydroprocessing. The invention also relates to systems and methods for such treating, to equipment useful for such treating, and to cavitated, hydroprocessed products.

9 Claims, 5 Drawing Sheets

(51) Int. Cl.

| | |
|---|---|
| ***C10G 47/02*** | (2006.01) |
| ***C10G 9/36*** | (2006.01) |
| *C10G 69/00* | (2006.01) |

(56) References Cited

U.S. PATENT DOCUMENTS

| | | | | |
|---|---|---|---|---|
| 3,278,415 | A | 10/1966 | Doberenz et al. | |
| 3,622,502 | A | 11/1971 | Mason et al. | |
| 3,755,143 | A | 8/1973 | Hosoi et al. | |
| 3,817,853 | A | 6/1974 | Folkins | |
| 4,066,530 | A | 1/1978 | Aldridge et al. | |
| 4,101,416 | A | 7/1978 | Dolbear | |
| 4,134,825 | A | 1/1979 | Aldridge et al. | |
| 4,173,529 | A | 11/1979 | Bauer | |
| 4,225,415 | A | 9/1980 | Mirza et al. | |
| 4,302,323 | A | 11/1981 | Chen | |
| 4,448,670 | A | 5/1984 | Dickakian | |
| 4,548,709 | A | 10/1985 | Bowes et al. | |
| 4,572,781 | A | 2/1986 | Krasuk et al. | |
| 4,732,664 | A | 3/1988 | Martini et al. | |
| 4,741,840 | A | 5/1988 | Atherton et al. | |
| 4,762,608 | A | 8/1988 | Didchenko | |
| 5,024,751 | A | 6/1991 | Giuliani et al. | |
| 5,158,668 | A | 10/1992 | Chahar et al. | |
| 5,169,039 | A | 12/1992 | Kay et al. | |
| 5,215,649 | A | 6/1993 | Grenoble et al. | |
| 5,233,112 | A | 8/1993 | Marler et al. | |
| 5,370,787 | A | 12/1994 | Forbus, Jr. | |
| 5,389,230 | A | 2/1995 | Veluswamy | |
| 5,443,715 | A | 8/1995 | Grenoble et al. | |
| 5,496,464 | A | 3/1996 | Piskorz et al. | |
| 5,620,591 | A | 4/1997 | Poole et al. | |
| 5,871,634 | A | 2/1999 | Wiehe et al. | |
| 5,954,950 | A | 9/1999 | Morel et al. | |
| 6,123,835 | A | 9/2000 | Ackerson et al. | |
| 6,409,912 | B1 | 6/2002 | Wallace et al. | |
| 6,413,413 | B1 | 7/2002 | Smith, Jr. | |
| 6,428,686 | B1 | 8/2002 | Ackerson et al. | |
| 6,579,443 | B1 | 6/2003 | Iaccino et al. | |
| 6,632,351 | B1 | 10/2003 | Ngan et al. | |
| 6,881,326 | B2 | 4/2005 | Ackerson et al. | |
| 7,090,765 | B2 | 8/2006 | Spicer et al. | |
| 7,097,758 | B2 | 8/2006 | Stell et al. | |
| 7,138,047 | B2 | 11/2006 | Stell et al. | |
| 7,220,887 | B2 | 5/2007 | Stell et al. | |
| 7,235,705 | B2 | 6/2007 | Stell | |
| 7,244,871 | B2 | 7/2007 | Stell et al. | |
| 7,247,765 | B2 | 7/2007 | Stell et al. | |
| 7,291,257 | B2 | 11/2007 | Ackerson et al. | |
| 7,291,258 | B2 | 11/2007 | Podrebarac et al. | |
| 7,297,833 | B2 | 11/2007 | Beattie et al. | |
| 7,311,746 | B2 | 12/2007 | Stell et al. | |
| 7,312,371 | B2 | 12/2007 | Stell et al. | |
| 7,351,872 | B2 | 4/2008 | Stell et al. | |
| 7,488,459 | B2 | 2/2009 | Stell et al. | |
| 7,578,929 | B2 | 8/2009 | Stell et al. | |
| 7,820,035 | B2 | 10/2010 | McCoy et al. | |
| 7,959,794 | B2 | 6/2011 | Galeazzi et al. | |
| 8,021,539 | B2 | 9/2011 | Hassan et al. | |
| 8,083,931 | B2 | 12/2011 | McCoy et al. | |
| 8,092,671 | B2 | 1/2012 | Strack et al. | |
| 8,128,808 | B2 | 3/2012 | Hassan et al. | |
| 9,090,835 | B2 | 7/2015 | Beech, Jr. et al. | |
| 2002/0056664 | A1 | 5/2002 | Chabot | |
| 2003/0085155 | A1 | 5/2003 | Chabot | |
| 2003/0100453 | A1* | 5/2003 | O'Rear | C10G 2/30 508/110 |
| 2003/0168383 | A1 | 9/2003 | Hoekstra et al. | |
| 2005/0167333 | A1 | 8/2005 | McCall et al. | |
| 2005/0209495 | A1 | 9/2005 | McCoy et al. | |
| 2006/0070912 | A1 | 4/2006 | Khan | |
| 2006/0076271 | A1 | 4/2006 | Bournay et al. | |
| 2006/0260983 | A1 | 11/2006 | Iki et al. | |
| 2007/0007170 | A1 | 1/2007 | Strack et al. | |
| 2007/0007171 | A1 | 1/2007 | Strack et al. | |
| 2007/0007173 | A1 | 1/2007 | Strack | |
| 2007/0017851 | A1 | 1/2007 | Mehra et al. | |
| 2007/0090018 | A1 | 4/2007 | Keusenkothen et al. | |
| 2007/0090021 | A1 | 4/2007 | McCall et al. | |
| 2007/0163921 | A1 | 7/2007 | Keusenkothen et al. | |
| 2008/0015839 | A1 | 1/2008 | Noureldin et al. | |
| 2008/0128323 | A1 | 6/2008 | McCoy | |
| 2008/0156700 | A1 | 7/2008 | Abulnaga et al. | |
| 2009/0000989 | A1 | 1/2009 | Hassan et al. | |
| 2009/0057200 | A1 | 3/2009 | Leta et al. | |
| 2009/0272671 | A1 | 11/2009 | Keusenkothen et al. | |
| 2010/0065472 | A1 | 3/2010 | Chabot | |
| 2010/0089794 | A1 | 4/2010 | Bhan et al. | |
| 2010/0122933 | A1 | 5/2010 | Khan | |
| 2010/0326887 | A1 | 12/2010 | McGehee et al. | |
| 2011/0005970 | A1 | 1/2011 | Ou et al. | |
| 2011/0083997 | A1 | 4/2011 | Silva et al. | |
| 2011/0163000 | A1 | 7/2011 | Lourenco et al. | |
| 2011/0174681 | A1 | 7/2011 | Milam et al. | |
| 2011/0180456 | A1 | 7/2011 | Davis et al. | |
| 2012/0118794 | A1 | 5/2012 | Ho et al. | |
| 2012/0181216 | A1* | 7/2012 | Kozyuk | C10G 45/00 208/85 |
| 2012/0273390 | A1 | 11/2012 | Dindi et al. | |
| 2012/0273391 | A1 | 11/2012 | Dindi et al. | |
| 2013/0068657 | A1 | 3/2013 | Dindi et al. | |
| 2013/0178673 | A1 | 7/2013 | Kim et al. | |
| 2013/0233764 | A1 | 9/2013 | Brown et al. | |
| 2014/0034549 | A1 | 2/2014 | Mukherjee et al. | |
| 2014/0061094 | A1 | 3/2014 | Xu et al. | |
| 2014/0061095 | A1 | 3/2014 | Beech, Jr. et al. | |
| 2014/0061096 | A1 | 3/2014 | Brown et al. | |
| 2014/0061100 | A1 | 3/2014 | Lattner et al. | |
| 2014/0061904 | A1 | 3/2014 | Liao | |
| 2014/0174980 | A1 | 6/2014 | Brown et al. | |

FOREIGN PATENT DOCUMENTS

| | | |
|---|---|---|
| DE | 550 157 | 4/1932 |
| EP | 0 274 604 | 7/1988 |
| EP | 0626440 | 11/1994 |
| EP | 2 336 268 | 6/2011 |
| EP | 2692834 | 2/2014 |
| GB | 1159843 | 7/1969 |
| GB | 2194794 | 3/1988 |
| WO | 2005/002701 | 1/2005 |
| WO | 2007/106775 | 9/2007 |
| WO | 2012/051922 | 4/2012 |
| WO | 2013/033580 | 3/2013 |
| WO | 2013/033582 | 3/2013 |
| WO | 2013/033590 | 3/2013 |

OTHER PUBLICATIONS

Tsonopoulos, Vapor-Liquid Critical Properties of Elements and Compounds. 3. Aromatic Hydrocarbons, 40 J. Chem. Eng. Data 547, 548, 1995.

* cited by examiner

METHODS AND SYSTEMS FOR TREATING A HYDROCARBON FEED

CROSS-REFERENCE TO RELATED APPLICATION

This application claims priority to and the benefit of U.S. Provisional Application No. 62/093,000, filed Dec. 17, 2014 and EP 15248031.5 filed Apr. 3, 2015, the disclosures of which are incorporated herein by reference in their entireties.

FIELD OF THE INVENTION

The invention relates to methods and systems for treating heavy hydrocarbon by cavitation and hydroprocessing. The invention also relates to systems and methods for such treating, to equipment useful for such treating, and to cavitated, hydroprocessed products.

BACKGROUND OF THE INVENTION

Pyrolysis processes, such as steam cracking, can be utilized for converting saturated hydrocarbons to higher-value products such as light olefin, e.g., ethylene and propylene. Besides these useful products, hydrocarbon pyrolysis can also produce a significant amount of relatively low-value, high-viscosity products, such as pyrolysis tar. Steam cracker tar ("SCT") is a pyrolysis tar obtained by steam cracking hydrocarbon.

SCT is a heavy hydrocarbon which contains relatively high molecular weight hydrocarbon molecules. These high-molecular weight molecules are conventionally called tar heavies ("TH"). It is conventional to dilute SCT with lower-molecular weight hydrocarbon in order to make it more useful as a blendstock for hydrocarbon fuels. In part to avoid the cost of added diluent, attempts have been made to upgrade undiluted SCT by catalytically hydroprocessing, e.g., to decrease viscosity and heteroatom content. It has been observed, however, that catalytically hydroprocessing undiluted SCT generally leads to a rapid onset of significant catalyst deactivation, primarily as a result of coke deposits on the hydroprocessing catalyst. The catalyst coking has been attributed to the presence of TH in the SCT and to the secondary oligomerization of radicals generated during the hydroprocessing.

It is conventional to lessen the amount of catalyst coking by (i) combining the SCT with a utility fluid to produce an SCT-utility fluid mixture, (ii) pre-heating the SCT-utility fluid mixture, (iii) hydroprocessing the preheated SCT-utility fluid mixture, (iv) and separating light gases and at least a portion of utility fluid boiling-range hydrocarbon from the hydroprocessed product to produce a raffinate comprising hydroprocessed SCT. The utility fluid comprises solvent having significant aromatics content. Compared to the SCT feed, the hydroprocessed SCT has a lesser kinematic viscosity, contains less sulfur, and has a lower insolubility number ("$I_N$"), resulting in improved compatibility of the hydroprocessed SCT with fuel oil blend-stocks.

One conventional SCT hydroprocessing technique, disclosed in P.C.T. Patent Application Publication No. WO2013/033590 A1, utilizes a molecular hydrogen partial pressure of at least about 1000 psig (about 68 bar). Although it is conventional to construct vessels that are suitable for hydroprocessing at such high pressures, it is desired to lessen hydroprocessing facility cost by operating the hydroprocessing at a lesser molecular hydrogen partial pressure. It is also desired to re-purpose for SCT hydroprocessing existing hydroprocessing facilities that are designed for other forms of hydroprocessing, which operate at lesser molecular hydrogen partial pressure, e.g., ≤600 psig (about 40 bar). It is particularly desired to develop SCT hydroprocessing which can operate at a lesser molecular hydrogen partial pressure without significant degradation in hydroprocessed SCT properties such as viscosity, $I_N$, and sulfur content. Although operating the hydroprocessing at (i) increased molecular hydrogen: SCT mass ratio and/or (ii) decreased temperature, might permit a reduction in molecular hydrogen partial pressure during hydroprocessing, it is desired to avoid the expense resulting from increasing the amount of molecular hydrogen and to avoid product viscosity increases that are observed when operating other forms of hydroprocessing at reduced temperature.

SUMMARY OF THE INVENTION

Certain aspects of the invention are based on the development of a heavy hydrocarbon upgrading process which includes cavitation and hydroprocessing. It has been found that when a heavy hydrocarbon, such as pyrolysis tar, is subjected to (i) cavitation and (ii) hydroprocessing, the hydroprocessing can be carried out at a molecular hydrogen partial pressure of <68 bar without a significant degradation of the kinematic viscosity, sulfur content, or $I_N$ of the hydroprocessed pyrolysis tar, compared to those properties in pyrolysis tar that is hydroprocessed at a greater molecular hydrogen partial pressure without cavitation. It has also been found that subjecting a heavy hydrocarbon to (i) hydroprocessing at any molecular hydrogen partial pressure that is effective for at least some hydroprocessing to occur and (ii) cavitation ((i) and (ii) being carried out in any order), produces a hydroprocessed heavy hydrocarbon having improved (decreased) kinematic viscosity compared to a hydroprocessed heavy hydrocarbon produced under substantially the same hydroprocessing conditions but without cavitation.

The cavitation can be carried out before or after the hydroprocessing. When the cavitation is carried out before the hydroprocessing, and particularly before SCT pre-heating, the resulting hydroprocessed SCT is observed to have an $I_N$ that is less than the $I_N$ of hydroprocessed SCT produced (i) without cavitation and (ii) when cavitation is carried out after the hydroprocessing. It has been observed that SCT cavitation produces an upgraded SCT having fewer 3-ring and 4-ring aromatics compared to the SCT feed. This allows hydroprocessing at conveniently long run-lengths with less utility fluid than is the case when the hydroprocessing an SCT that has not been subjected to prior cavitation.

It is observed that when the cavitation is carried out after the hydroprocessing, it is advantageous to lessen the amount of vapor-phase material present in the hydroprocessed product during the cavitation by separating and conducting away at least a portion of any light gases before the cavitation. It is also observed that there is little if any benefit to cavitating the hydroprocessed SCT in the presence of utility-fluid boiling-range hydrocarbon. It is consequently convenient to separate utility-fluid boiling-range hydrocarbon from the hydroprocessed product upstream of the cavitation of the hydroprocessed SCT, e.g., to carry out the cavitation on the raffinate. This aspect has an additional benefit that the cavitation equipment can be of lesser hydraulic capacity compared to cavitation equipment utilized for hydroprocessing the entire liquid-phase portion of the hydroprocessed product.

Accordingly, certain aspects of the invention relate to a heavy hydrocarbon treatment method. The heavy hydrocarbon has a mass density ≥1.0 kg/m$^2$ and a kinematic viscosity (measured at 50° C.) ≥30 mm$^2$/sec ("cSt"). A heavy hydrocarbon+utility fluid mixture can be produced by combining the heavy hydrocarbon with a utility fluid which (i) comprises 1-ring and/or 2-ring aromatics in an amount ≥25.0 wt. % and (ii) has a final boiling point ≤430° C. The heavy hydrocarbon+utility fluid mixture has a heavy hydrocarbon: utility fluid weight ratio in the range of 0.05 to 4.0. The heavy hydrocarbon+utility fluid mixture is hydroprocessed to produce a hydroprocessed product having a kinematic viscosity (measured at 50° C.) of $KV_a$. The method further includes cavitating at least a portion of the hydroprocessed product to produce a treated product having a kinematic viscosity (measured at 50° C.) of $KV_b$, wherein $KV_b = (x*KV_a)$ and x is a positive real number ≤0.95. The invention includes the treated products produced by this method.

In other aspects, the invention relates to a heavy hydrocarbon treatment method where the cavitation is carried out before the hydroprocessing. In accordance with this aspect, a heavy hydrocarbon having a mass density ≥1.0 kg/m$^2$ and a kinematic viscosity (measured at 50° C.) $KV_i$≥30 cSt is subjected to cavitation to produce a cavitated heavy hydrocarbon having a kinematic viscosity (measured at 50° C.) of $KV_c$, wherein (i) $KV_c$ is $=(y*KV_i)$ and (ii) y is a positive real number ≤0.95. The method continues by hydroprocessing at least a portion of the cavitated heavy hydrocarbon to produce a treated product. It can be advantageous to carry out the cavitation without exposing the heavy hydrocarbon to a temperature ≥200° C. The invention includes the treated products produced by this method. The hydroprocessing can be carried out in the presence of a utility fluid which comprises 1-ring and/or 2-ring aromatics in an amount ≥25.0 wt. % and (ii) has a final boiling point ≤430° C.

In other aspects, the invention relates to a system for treating a heavy hydrocarbon feed. The system includes a hydroprocessor unit, wherein the hydroprocessor unit (i) comprises at least one inlet for receiving a heavy hydrocarbon feed, (ii) comprises at least one outlet for withdrawing a hydroprocessed product, and (iii) is configured to expose the heavy hydrocarbon feed to a temperature in the range of from 300° C. to 500° C. in the presence of molecular hydrogen. The system also includes a cavitation unit in fluidic communication with the hydroprocessing unit, wherein the cavitation unit comprises (i) at least one inlet configured for receiving at least a portion of the hydroprocessed product from the hydroprocessing unit, (ii) at least outlet for withdrawing a treated hydrocarbon, (iii) a first region in fluidic communication with the cavitation unit's inlet, the first region being configured for exposing the hydroprocessed product to an increased pressure sufficient to cause cavitation vaporization in the hydroprocessed product, (iv) a second region in fluidic communication with the outlet and the first region, the second region being configured to receive the cavitated, hydroprocessed product and to expose the cavitated, hydroprocessed product to a decreased pressure sufficient to cause condensation of at least a portion of the cavitation vapor.

In other aspects, the invention relates a system for treating a hydrocarbon feed, wherein at least one cavitation unit is located upstream of the hydroprocessing unit. Accordingly, the system includes a cavitation unit comprising (i) at least one inlet for receiving a heavy hydrocarbon feed, (ii) at least one outlet for withdrawing a cavitation unit effluent, (iii) a first region in fluidic communication with the cavitation unit's inlet, the first region being configured for exposing the heavy hydrocarbon feed to an increased pressure sufficient to cause cavitation vaporization in the heavy hydrocarbon feed, (iv) a second region in fluidic communication with the outlet and the first region, the second region being configured to receive the cavitated heavy hydrocarbon feed and to expose the cavitated heavy hydrocarbon feed to a decreased pressure sufficient to cause condensation of at least a portion of the cavitation vapor. The system further includes a hydroprocessor unit, wherein the hydroprocessor unit (i) comprises at least one inlet for receiving at least a portion of the cavitation unit effluent, (ii) comprises at least one outlet for withdrawing a treated product, and (iii) is configured to expose the cavitation unit effluent to a temperature in the range of from 300° C. to 500° C. in the presence of molecular hydrogen to produce the treated product.

In other aspects, the invention relates to a cavitated, hydroprocessed heavy hydrocarbon having a kinematic viscosity (measured at 50° C.) ≤30 cSt and an $I_N$≤80. In certain aspects, the cavitated, hydroprocessed heavy hydrocarbon comprises cavitated, hydroprocessed steam cracker tar having one or more of a sulfur content ≤1.0 wt. %, a kinematic viscosity (measured at 50° C.) ≤20 cSt, and a mass density ≤1.1 kg/m$^2$.

DETAILED DESCRIPTION OF THE INVENTION

Figure 1:
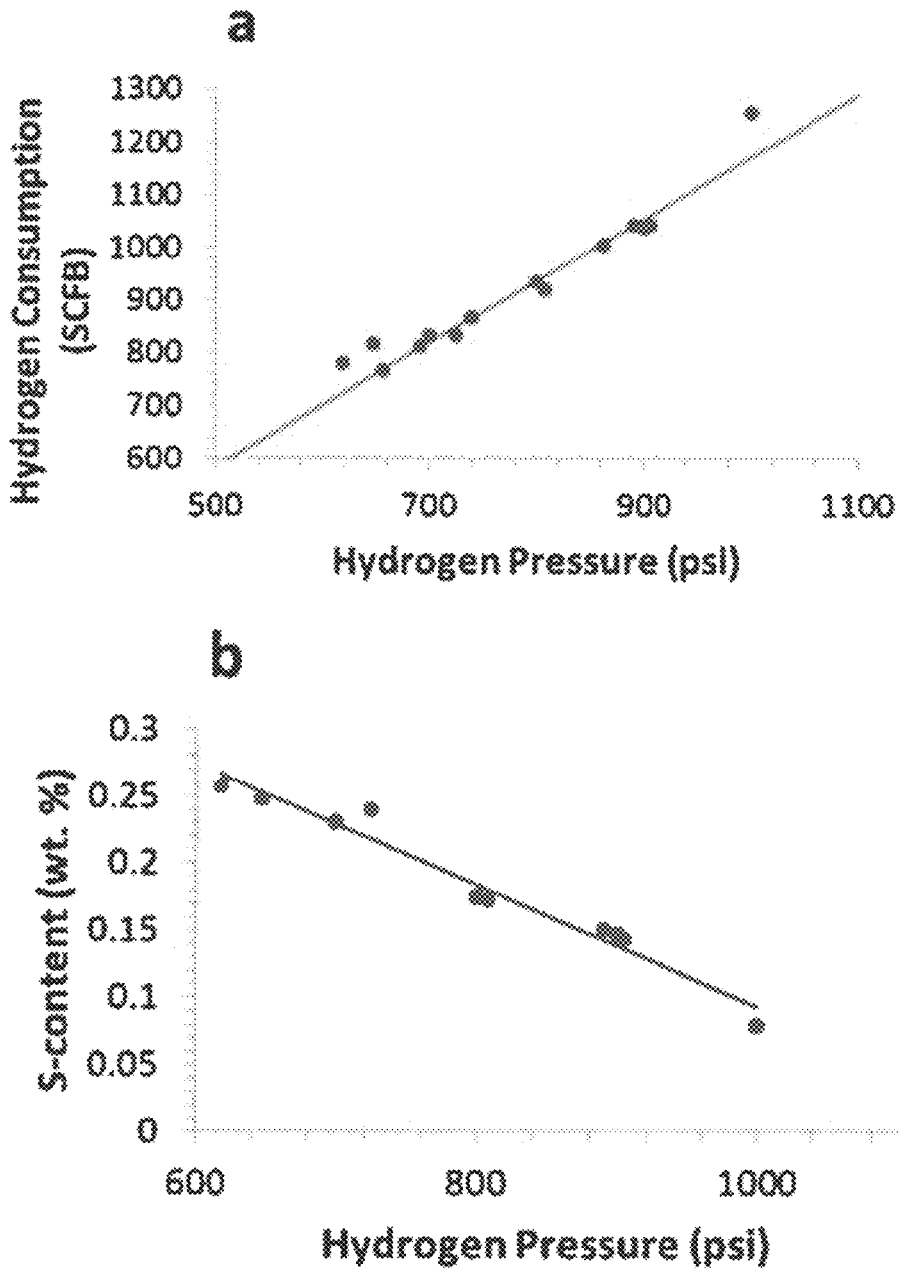
FIG. 1*a* depicts the change in molecular hydrogen consumption as a function of molecular hydrogen concentration during hydroprocessing of a representative SCT.
FIG. 1*b* shows the change in sulfur content of a representative hydroprocessed SCT as a function of molecular hydrogen partial pressure during SCT hydroprocessing.

Aspects of the invention are generally useful for improving properties of heavy hydrocarbon, e.g., one or more of density, kinematic viscosity, sulfur content, and blending characteristics such as insolubility number and solubility blending number. The treated product is typically useful as a blending component for producing fuel oil, e.g., for blending into one or more residual fuel oils, such as one or more of No. 5 fuel oil, Number 6 fuel oil, Bunker C fuel oil, etc. The treatment is carried out by subjecting a heavy hydrocarbon feed to cavitation and hydroprocessing.

Certain aspects of the invention will now be described in more detail. Although the following description relates to particular aspects, those skilled in the art will appreciate that these are exemplary only, and that the invention can be practiced in other ways. References to the "invention" may refer to one or more, but not necessarily all, of the inventions defined by the claims. The use of headings is solely for convenience, and these should not be interpreted as limiting the scope of the invention to particular aspects.

Definitions

For the purpose of this description and appended claims, the following terms are defined: The term "$C_n$" hydrocarbon wherein n is a positive integer means hydrocarbon having n carbon atom(s) per molecule. The term "$C_{n+}$" hydrocarbon wherein n is a positive integer means hydrocarbon having at least n carbon atom(s) per molecule. The term "$C_{n-}$" hydrocarbon wherein n is a positive integer means hydrocarbon having no more than n carbon atom(s) per molecule. The term "hydrocarbon" means compounds containing hydrogen bound to carbon, and encompasses (i) saturated hydrocarbon, (ii) unsaturated hydrocarbon, and (iii) mixtures of hydrocarbons, including mixtures of hydrocarbons (saturated and/or unsaturated) having different values of n.

"Heavy hydrocarbon" means hydrocarbon having a mass density ≥1.0 kg/m$^2$ and a kinematic viscosity (measured at 50° C.) ≥30 cSt. The heavy hydrocarbon can be one having a T50 boiling point (the temperature at which 50 wt. % of the heavy hydrocarbon boils off at atmospheric pressure) ≥204° C. and/or a T95 boiling point (the temperature at which 95 wt. % of the heavy hydrocarbon boils off at atmospheric pressure) ≥343° C. For example, the heavy hydrocarbon can be a pyrolysis tar, such as an SCT having a T5 boiling point (the temperature at which 5 wt. % of the material boils off at atmospheric pressure)≥149° C. and/or a T95 boiling point that is (i) ≥590° C. and/or (ii) ≤760° C.

"Pyrolysis tar" means a mixture comprising (a) hydrocarbon having one or more aromatic molecules and optionally (b) non-aromatic and/or non-hydrocarbon molecules, the mixture being derived from hydrocarbon pyrolysis, with at least 70% of the mixture having a boiling point at atmospheric pressure that is ≥290° C. Certain pyrolysis tars have one or more of the following properties: an initial boiling point at atmospheric pressure ≥200° C.; ≥90.0 wt. % of the pyrolysis tar has a boiling point at atmospheric pressure ≥290° C. Pyrolysis tar can comprise, e.g., ≥50.0 wt. %, e.g., ≥75.0 wt. %, such as ≥90.0 wt. %, based on the weight of the pyrolysis tar, of hydrocarbon molecules (including mixtures and aggregates thereof) having (i) one or more aromatic components and (ii) a number of carbon atoms ≥about 15. Pyrolysis tar generally has a metals content, ≤1.0×10$^3$ ppmw, based on the weight of the pyrolysis tar, which is an amount of metals that is far less than that found in crude oil (or crude oil components) of the same average viscosity. "SCT" means pyrolysis tar obtained from steam cracking.

"Tar Heavies" (TH) means a product of hydrocarbon pyrolysis which have a boiling point at atmospheric pressure ≥565° C. and comprise ≥5.0 wt. % of molecules having a plurality of aromatic cores based on the weight of the product. The TH are typically solid at 25.0° C. and generally include the fraction of SCT that is not soluble in a 5:1 (vol.:vol.) ratio of n-pentane: SCT at 25.0° C. TH generally include asphaltenes and other high molecular weight molecules.

"Solubility blending number" ("$S_{BN}$") and "insolubility number" ("$I_N$") are described in U.S. Pat. No. 5,871,634, incorporated herein by reference in its entirety, and determined using n-heptane as the so-called "nonpolar, nonsolvent" and chlorobenzene as the solvent ratio of oil to test liquid mixture is in the range of from 1.0 to 5.0. Kinematic viscosity can be measured by A.S.T.M. D445. Density can be measured by A.S.T.M. D4052. Sulfur content can be measured by A.S.T.M. D2622.

"Cavitation" means purposefully subjecting a fluid to a convective acceleration, followed by a pressure drop and bubble formation, and then to a convective deceleration and bubble implosion. Typically, the convective acceleration, pressure drop (and bubble formation), and convective deceleration (and bubble implosion) occur without intervening process steps, e.g., without intervening chemical conversion steps. Cavitation as used herein typically does not encompass natural cavitation as might occur during conventional hydrocarbon hydroprocessing, such as that which can occur when a hydrocarbon fluid traverses a hydroprocessing vessel or catalyst bed. Cavitation is typically carried out in one or more cavitation stages that are physically separate and distinct from hydroprocessing stages. The cavitation can be hydrodynamic cavitation, including hydrodynamic cavitation carried out in one or more conventional cavitation units. Hydrodynamic cavitation is disclosed in U.S. Pat. Nos. 5,492,654; 5,937,906; 5,969,207; 6,502,979; 7,086,777; and 7,357,566, all of which are incorporated by reference herein in their entirety.

The term "Periodic Table" means the Periodic Chart of the Elements, as it appears on the inside cover of The Merck Index, Twelfth Edition, Merck & Co., Inc., 1996.

The invention generally relates to upgrading heavy hydrocarbon by cavitation and hydroprocessing. In certain aspects, the heavy hydrocarbon includes ≥50.0 wt. % of pyrolysis tar, such as steam cracker tar, e.g., ≥75.0 wt. %, or ≥90.0 wt. %, or ≥95.0 wt. %, or ≥99.0 wt. %. The heavy hydrocarbon can consist essentially of or consist of pyrolysis tar, such as steam cracker tar. Pyrolysis tar is typically produced by exposing a hydrocarbon-containing feed (the "pyrolysis feed") to pyrolysis conditions in order to produce a pyrolysis effluent, the pyrolysis effluent being a mixture comprising (i) unreacted pyrolysis feed, (ii) saturated and unsaturated hydrocarbon produced from the feed during the pyrolysis and a boiling point at atmospheric pressure within or below the gas oil boiling-range (e.g., within or below the steam cracker gas oil boiling range, and pyrolysis tar. Typically, pyrolysis feed comprises ≥10.0 wt. % hydrocarbon, based on the weight of the pyrolysis feed. When such a feed is subjected to pyrolysis, the pyrolysis tar generally comprises ≥90 wt. % of the pyrolysis effluent's molecules having an atmospheric boiling point of ≥290° C. Besides hydrocarbon, the pyrolysis feed optionally further comprises diluent, e.g., one or more of nitrogen, water, etc. For example, the pyrolysis feed may further comprise ≥1.0 wt. % diluent based on the weight of the feed, such as ≥25.0 wt. %. When the diluent includes an appreciable amount of steam, the pyrolysis is referred to as steam cracking.

Aspects of the invention which include producing SCT by steam cracking will now be described in more detail. The invention is not limited to these aspects, and this description is not meant to foreclose other aspects within the broader scope of the invention, such as those which do not include steam cracking.

Obtaining Pyrolysis Tar by Steam Cracking

Conventional steam cracking utilizes a pyrolysis furnace which has two main sections: a convection section and a radiant section. The pyrolysis feed typically enters the convection section of the furnace where the pyrolysis feed's hydrocarbon is heated and vaporized by indirect contact with hot flue gas from the radiant section and by direct contact with the pyrolysis feed's steam. The vaporized pyrolysis feed is then introduced into the radiant section where ≥50% (weight basis) of the cracking takes place. A pyrolysis effluent is conducted away from the pyrolysis furnace, the pyrolysis effluent comprising products resulting from the pyrolysis of the pyrolysis feed and any unconverted components of the pyrolysis feed. At least one separation stage is generally located downstream of the pyrolysis furnace, the separation stage being utilized for separating from the pyrolysis effluent one or more of light olefin, SCN, SCGO, SCT, unreacted hydrocarbon components of the pyrolysis feed, etc. The separation stage can comprise, e.g., a primary fractionator. Generally, at least one cooling stage is located between the pyrolysis furnace and the separation stage. Conventional cooling means can be utilized by the cooling stage, e.g., one or more of direct quench and/or indirect heat exchange, but the invention is not limited thereto. At least a portion of the SCT is subjected to cavitation and hydroprocessing. Particular steam cracking aspects will now be described in more detail.

Pyrolysis Feeds for Steam Cracking

In one aspect, the pyrolysis feed comprises ≥10.0 wt. % hydrocarbon, based on the weight of the pyrolysis feed, e.g., ≥25.0 wt. %, ≥50.0 wt. %, such as ≥0.65 wt. %. Although the pyrolysis feed's hydrocarbon can comprise a light hydrocarbon such as one or more of methane, ethane, propane, butane etc., it can be particularly advantageous to utilize the invention in connection with a pyrolysis feed comprising a significant amount of higher molecular weight hydrocarbons because the pyrolysis of these molecules generally results in more SCT than does the pyrolysis of lower molecular weight hydrocarbons. As an example, the pyrolysis feed can comprise ≥1.0 wt. % or ≥25.0 wt. % based on the weight of the pyrolysis feed of hydrocarbon that is in the liquid phase at ambient temperature and atmospheric pressure.

In another aspect, the pyrolysis feed's hydrocarbon comprises ≥5 wt. % of non-volatile components, based on the weight of the hydrocarbon portion, e.g., ≥30 wt. %, such as ≥40 wt. %, or in the range of 5 wt. to 50 wt. %. Non-volatile components are the fraction of the hydrocarbon feed with a nominal boiling point above 590° C. as measured by A.S.T.M. D-6352-98, D-7580. These A.S.T.M. methods can be extrapolated, e.g., when a hydrocarbon has a final boiling point that is greater than that specified in the standard. The hydrocarbon's non-volatile components can include coke precursors, which are moderately heavy and/or reactive molecules, such as multi-ring aromatic compounds, which can condense from the vapor phase and then form coke under the specified operating conditions. Examples of suitable hydrocarbon include one or more of steam cracked gas oil and residues, gas oils, heating oil, fuel, diesel, kerosene, gasoline, coker naphtha, steam cracked naphtha, catalytically cracked naphtha, hydrocrackate, reformate, raffinate reformate, Fischer-Tropsch liquids, Fischer-Tropsch gases, natural gasoline, distillate, virgin naphtha, crude oil, atmospheric pipestill bottoms, vacuum pipestill streams including bottoms, wide boiling-range naphtha to gas oil condensates, heavy non-virgin hydrocarbon streams from refineries, vacuum gas oils, heavy gas oil, naphtha contaminated with crude, atmospheric residue, heavy residue, $C_4$/residue admixture, naphtha/residue admixture, gas oil/residue admixture, and crude oil. The pyrolysis feed's hydrocarbon can have a nominal final boiling point of at least about 315° C., generally greater than about 510° C., typically greater than about 590° C., for example greater than about 760° C. Nominal final boiling point means the temperature at which 99.5 weight percent of a particular sample has reached its boiling point.

In another aspect, the pyrolysis feed's hydrocarbon comprises ≥10.0 wt. %, e.g., ≥50.0 wt. %, such as ≥90.0 wt. % (based on the weight of the hydrocarbon) of one or more of naphtha, gas oil, vacuum gas oil, waxy residues, atmospheric residues, residue admixtures, or crude oil; including those comprising ≥about 0.1 wt. % asphaltenes. When the hydrocarbon includes crude oil and/or one or more fractions thereof, the crude oil is optionally desalted prior to being included in the pyrolysis feed. An example of a crude oil fraction utilized in the pyrolysis feed is produced by separating atmospheric pipestill ("APS") bottoms from a crude oil and followed by vacuum pipestill ("VPS") treatment of the APS bottoms.

Suitable crude oils include, e.g., high-sulfur virgin crude oils, such as those rich in polycyclic aromatics. For example, the pyrolysis feed's hydrocarbon can include ≥90.0 wt. % of one or more crude oils and/or one or more crude oil fractions, such as those obtained from an atmospheric APS and/or VPS; waxy residues; atmospheric residues; naphthas contaminated with crude; various residue admixtures; and SCT.

Optionally, the pyrolysis feed's hydrocarbon comprises sulfur, e.g., ≥0.1 wt. % sulfur based on the weight of the pyrolysis feed's hydrocarbon, e.g., ≥1.0 wt. %, such as in the range of about 1.0 wt. % to about 5.0 wt. %. Optionally, at least a portion of the pyrolysis feed's sulfur-containing molecules, e.g., ≥10.0 wt. % of the pyrolysis feed's sulfur-containing molecules, contain at least one aromatic ring ("aromatic sulfur"). When (i) the pyrolysis feed's hydrocarbon is a crude oil or crude oil fraction comprising ≥0.1 wt. % of aromatic sulfur and (ii) the pyrolysis is steam cracking, then the SCT contains a significant amount of sulfur derived from the pyrolysis feed's aromatic sulfur. For example, the SCT sulfur content can be about 3 to 4 times higher in the SCT than in the pyrolysis feed's hydrocarbon component, on a weight basis.

It has been found that including sulfur and/or sulfur-containing molecules in the pyrolysis feed lessens the amount of olefinic unsaturation (and the total amount of olefin) present in the SCT. For example, when the pyrolysis feed's hydrocarbon comprises sulfur, e.g., ≥0.1 wt. % sulfur based on the weight of the pyrolysis feed's hydrocarbon, e.g., ≥1.0 wt. %, such as in the range of about 1.0 wt. % to about 5.0 wt. %, then the amount of olefin contained in the SCT is ≤10.0 wt. %, e.g., ≤5.0 wt. %, such as ≤2.0 wt. %, based on the weight of the SCT. More particularly, the amount of (i) vinyl aromatics in the SCT and/or (ii) aggregates in the SCT which incorporate vinyl aromatics is ≤5.0 wt. %, e.g., ≤3 wt. %, such as ≤2.0 wt. %. While not wishing to be bound by any theory or model, it is believed that the amount of olefin in the SCT is lessened because the presence of feed sulfur leads to an increase in amount of sulfur-containing hydrocarbon molecules in the pyrolysis effluent. Such sulfur-containing molecules can include, for example, one or more of mercaptans; thiophenols; thioethers, such as heterocyclic thioethers (e.g., dibenzosulfide; thiophenes, such as benzothiophene and dibenzothiophene; etc. The formation of these sulfur-containing hydrocarbon molecules is believed to lessen the amount of relatively high molecular weight olefinic molecules (e.g., $C_{6+}$ olefin) produced during and after the pyrolysis, which results in fewer vinyl aromatic molecules available for inclusion in SCT, e.g., among the SCT's TH aggregates. In other words, when the pyrolysis feed includes sulfur, the pyrolysis favors the formation in the SCT of sulfur-containing hydrocarbon, such as $C_{6+}$ mercaptan, over $C_{6+}$ olefins such as vinyl aromatics.

In certain aspects, the pyrolysis feed comprises steam in an amount in the range of from 10.0 wt. % to 90.0 wt. %, based on the weight of the pyrolysis feed, with the remainder of the pyrolysis feed comprising the hydrocarbon. Such a pyrolysis feed can be produced by combining hydrocarbon with steam, e.g., at a ratio of 0.1 to 1.0 kg steam per kg hydrocarbon, or a ratio of 0.2 to 0.6 kg steam per kg hydrocarbon.

Steam Cracking

The pyrolysis feed is conducted to at least one steam cracker where the pyrolysis feed is subjected to pyrolysis under steam cracking conditions to produce the pyrolysis effluent. More than one steam cracking furnace can be used, and these can be operated (i) in parallel, where a portion of the pyrolysis feed is transferred to each of a plurality of furnaces and/or (ii) in series, where at least a second furnace is located downstream of a first furnace, the second furnace being utilized for cracking unreacted pyrolysis feed components in the first furnace's pyrolysis effluent.

Suitable steam cracking conditions include, e.g., exposing the pyrolysis feed to a temperature (measured at the radiant outlet) ≥400° C., e.g., in the range of 400° C. to 900° C., and a pressure ≥0.1 bar, for a cracking residence time period in the range of from about 0.01 second to 5.0 second. In some aspects, the pyrolysis feed comprises hydrocarbon and diluent, wherein a. the pyrolysis feed's hydrocarbon comprises ≥50.0 wt. % based on the weight of the pyrolysis feed's hydrocarbon of one or more crude oils and/or one or more crude oil fractions, such as those obtained from an APS and/or VPS; waxy residues; atmospheric residues; naphthas contaminated with crude; various residue admixtures; and SCT; and b. the pyrolysis feed's diluent comprises, e.g., ≥95.0 wt. % water based on the weight of the diluent, wherein the amount of diluent in the pyrolysis feed is in the range of from about 10.0 wt. % to 90.0 wt. %, based on the weight of the pyrolysis feed.

In these aspects, the steam cracking conditions generally include one or more of (i) a temperature in the range of 760° C. to 880° C.; (ii) a pressure in the range of from 1.0 to 5.0 bar (absolute), or (iii) a cracking residence time in the range of from 0.10 to 2.0 seconds.

A pyrolysis effluent is conducted away from the pyrolysis furnace, the pyrolysis effluent being derived from the pyrolysis feed by the pyrolysis. When utilizing the specified pyrolysis feed and pyrolysis conditions of any of the preceding aspects, the pyrolysis effluent generally comprises ≥1.0 wt. % of $C_2$ unsaturates and ≥0.1 wt. % of TH, the weight percents being based on the weight of the pyrolysis effluent. Optionally, the pyrolysis effluent comprises ≥5.0 wt. % of $C_2$ unsaturates and/or ≥0.5 wt. % of TH, such as ≥1.0 wt. % TH. Although the pyrolysis effluent generally contains a mixture of the desired light olefins, SCN, SCGO, SCT, and unreacted components of the pyrolysis feed (e.g., water in the case of steam cracking, but also in some cases unreacted hydrocarbon), the relative amount of each of these generally depends on, e.g., the pyrolysis feed's composition, pyrolysis furnace configuration, process conditions during the pyrolysis, etc. The pyrolysis effluent is generally conducted away for the pyrolysis section, e.g., for cooling and separation.

In one aspect, the pyrolysis effluent's TH comprise ≥10.0 wt. % of TH aggregates having an average size in the range of 10.0 nm to 300.0 nm in at least one dimension and an average number of carbon atoms ≥50, the weight percent being based on the weight of TH in the pyrolysis effluent. Generally, the aggregates comprise ≥50.0 wt. %, e.g., ≥80.0 wt. %, such as ≥90.0 wt. % of TH molecules having a C:H atomic ratio in the range of from 1.0 to 1.8, a molecular weight in the range of 250 to 5000, and a melting point in the range of 100° C. to 700° C.

Cooling the Pyrolysis Effluent

The pyrolysis effluent is typically cooled downstream of the pyrolysis furnace in order to facilitate separating the desired light olefin products. For example, the pyrolysis effluent can be cooled by directly injecting a quench fluid and/or by indirect heat transfer in one or more quench exchangers. Suitable quench fluids include liquid quench oil, such as those obtained by a downstream quench oil knock-out drum, pyrolysis fuel oil and water, which can be obtained from conventional sources, e.g., condensed dilution steam.

Pyrolysis Effluent Separation Stage

At least one separation stage is typically utilized for separating from the pyrolysis effluent (i) vapor-phase products such as one or more of acetylene, ethylene, propylene, butenes, and (ii) liquid-phase products comprising, e.g., one or more of $C_{5+}$ molecules, and mixtures thereof. Conventional separation equipment can be utilized in the separation stage, e.g., one or more flash drums, fractionators, water-quench towers, indirect condensers, etc., such as those described in U.S. Pat. No. 8,083,931, but the invention is not limited thereto. For example, the separation stage can include a primary fractionator for separating from the pyrolysis effluent or cooled pyrolysis effluent one or more of (a) an overhead stream comprising steam-cracked naphtha ("SCN", e.g., $C_5$-$C_{10}$ species) and steam cracked gas oil ("SCGO"), the SCGO comprising ≥90.0 wt. % based on the weight of the SCGO of molecules (e.g., $C_{10}$-$C_{17}$ species) having an atmospheric boiling point in the range of about 200° C. to 290° C., and (b) a bottoms stream comprising ≥90.0 wt. % SCT, based on the weight of the bottoms stream (the balance of the bottoms stream can include particulates, for example.). The SCT can have, e.g., an initial boiling point at atmospheric pressure ≥about 290° C., and can comprise molecules and mixtures thereof having a number of carbon atoms ≥about 15. In certain aspects the SCT is obtained from tar knock-out drum bottoms. In other aspects the SCT is obtained from a mixture of tar knock-out drum bottoms and primary fractionator bottoms.

In one aspect, the SCT comprises ≥50.0 wt. % of the pyrolysis effluent's TH based on the weight of the pyrolysis effluent's TH. For example, the SCT can comprise ≥90.0 wt. % of the pyrolysis effluent's TH based on the weight of the pyrolysis effluent's TH. The SCT can have, e.g., (i) a sulfur content in the range of 0.5 wt. % to 7.0 wt. %, based on the weight of the SCT; (ii) a TH content in the range of from 5.0 wt. % to 40.0 wt. %, based on the weight of the SCT; (iii) a density at 15° C. in the range of 1.01 g/cm$^3$ to 1.15 g/cm$^3$, e.g., in the range of 1.07 g/cm$^3$ to 1.15 g/cm$^3$; and (iv) a 50° C. viscosity in the range of 200 cSt to $1.0\times10^7$ cSt. The amount of olefin the SCT is generally ≤10.0 wt. %, e.g., ≤5.0 wt. %, such as ≤2.0 wt. %, based on the weight of the SCT. More particularly, the amount of (i) vinyl aromatics in the SCT and/or (ii) aggregates in the SCT which incorporate vinyl aromatics is generally ≤5.0 wt. %, e.g., ≤3 wt. %, such as ≤2.0 wt. %, based on the weight of the SCT.

SCT Upgrading

At least a portion of the separated SCT is subjected to cavitation and hydroprocessing to produce a treated SCT. The cavitation and hydroprocessing can be carried out in any order, e.g., (i) the SCT is cavitated and at least a portion of the cavitated SCT is hydroprocessed; (ii) the SCT is hydroprocessed and at least a portion of the hydroprocessed SCT is cavitated; (iii) the SCT is cavitated, at least a portion of the cavitated SCT is hydroprocessed, and at least a portion of the cavitated, hydroprocessed SCT is subjected to a second cavitation; (iv) the SCT is hydroprocessed, the hydroprocessed SCT is cavitated, the hydroprocessed, cavitated SCT is subjected to a second hydroprocessing, etc. Aspects (i)-(iv) can be utilized in combination, and repeated if desired, e.g., Cav-Hyd-Cav; Hyd-Cav-Hyd; Cav-Hyd-Cav-Hyd; Hyd-Cav-Hyd-Cav; etc., where "Cav" means cavitation, and "Hyd" means hydroprocessing. Although a cavitation stage is typically followed by a hydroprocessing stage, and vice versa, this is not required. Aspects such as Cav-Cav-Hyd and Hyd-Hyd-Cav are within the scope of the invention, as are Cav-Sep-Hyd and Hyd-Sep-Cav, where "Sep" means at least one separation carried out between cavitation and hydroprocessing.

In certain aspects, the heavy hydrocarbon is subjected to cavitation upstream of the hydroprocessing, with no additional cavitation occurring downstream of the hydroprocessing. In other aspects, the heavy hydrocarbon is subjected to cavitation upstream of the hydroprocessing, and additional cavitation is carried out on at least a portion of the hydroprocessed product downstream of the hydroprocessing. In other aspects (i) the heavy hydrocarbon is not subjected to cavitation before the hydroprocessing and (ii) at least a portion of the hydroprocessed product is subjected to cavitation.

Aspects of the invention which include SCT (or cavitated SCT) hydroprocessing and SCT (or hydroprocessed SCT) cavitation will now be described in more detail. The invention is not limited to these aspects, and this description is not meant to foreclose other aspects within the broader scope of the invention, such as those which include cavitation and/or hydroprocessing of a heavy hydrocarbon that does not comprise SCT.

Hydroprocessing

Hydroprocessing can be carried out under conventional heavy hydrocarbon hydroprocessing conditions, such as conventional SCT hydroprocessing conditions. Suitable hydroprocessing conditions include those disclosed in P.C.T. Patent Application Publication Nos. WO2013/033690 and WO2013/033582, the specifications of which are incorporated by reference herein in their entirety. In accordance with one aspect of the invention, less hydroprocessor fouling, greater hydroprocessing run lengths, and improved properties of the hydroprocessed SCT are obtained by combining utility fluid with the SCT to produce an SCT+utility fluid mixture before and/or during the hydroprocessing. The hydroprocessing is carried out in the presence of molecular hydrogen, typically included in a "treat gas", and optionally in the presence of a catalytically effective amount of at least one hydroprocessing catalyst. Typically, the treat gas is primarily in the vapor-phase during the hydroprocessing, with the SCT and utility fluid being primarily in the liquid phase. Treat gas can be combined with the SCT+utility fluid mixture before and/or during the hydroprocessing. Effluent from the hydroprocessor is optionally cooled to increase the relative amount of liquid-phase material in the hydroprocessed product.

It has been found that there is a beneficial decrease in the rate of deposit formation before, during, and after the hydroprocessing when the utility fluid comprises aromatics and has a final boiling point ≤430° C. Typically, the utility fluid is one which (i) comprises ≥25.0 wt. % of 1-ring and 2-ring aromatics (i.e., those aromatics having one or two rings and at least one aromatic core), based on the weight of the utility fluid, and (ii) has a final boiling point ≤430° C., preferably ≤400° C. Suitable utility fluids include those where ≥90.0 wt. % of the utility fluid has an atmospheric boiling point ≥150° C., e.g., ≥163° C., such as ≥175° C.; and ≤10.0 wt. % of the utility fluid has an atmospheric boiling point ≥430° C., e.g., ≥413° C., such as ≥400° C. Optionally, the utility fluid is one where ≥95.0 wt. % of the utility fluid has an atmospheric boiling point ≥150° C., e.g., ≥163° C., such as ≥175° C.; and ≤5.0 wt. % of the utility fluid has an atmospheric boiling point ≥430° C., e.g., ≥413° C., such as ≥400° C. A true boiling point distribution can be determined, e.g., by conventional methods such as the method of A.S.T.M. D7500. When the final boiling point is greater than that specified in the standard, the true boiling point distribution can be determined by extrapolation. Typically, the utility fluid has a true boiling point distribution having (i) an initial boiling point ≥150° C., e.g., ≥163° C., such as ≥175° C., and (ii) a final boiling point ≤430° C., e.g., ≤413° C., such as ≤400° C.; e.g., having a true boiling point distribution in the range of from 175° C. to about 400° C. It is believed that utilizing a utility fluid having a final boiling point ≥430° C. leads to an increase in fouling (e.g., coking) in the reactor and/or preheat equipment upstream of the hydroprocessor, even when such utility fluids have more than the desired minimum aromatic content (≥25.0 wt. % of 1-ring and 2-ring aromatics, based on the weight of the utility fluid). Since it is believed that the increased non-aromatic content of utility fluids having a relatively low initial boiling point, such as those where ≥10 wt. % of the utility fluid has an atmospheric boiling point ≤175° C., can lead to SCT-utility fluid incompatibility and asphaltene precipitation, the utility fluid optionally has an initial boiling point ≥175° C.

The hydroprocessing can be carried out under pyrolysis tar hydroprocessing conditions. The hydroprocessing reactor operating temperature is typically ≤500° C., e.g., the feed to the hydroprocessing is exposed to a temperature that is within the range of about 300° C. to about 500° C. at all times during the hydroprocessing. For example, during the hydroprocessing the hydroprocessing feed is exposed to a temperature within a range extending from a lower limit of about 300° C., about 325° C., about 350° C., or about 375° C., to an upper limit of about 500° C., about 475° C., about 450° C., or about 425° C. The hydroprocessing reactor typically has a molecular hydrogen partial pressure ≥about 30 bar (abs), e.g., in the range of 30 bar to 700 bar, such as 33 bar to 100 bar. When the heavy hydrocarbon is a pyrolysis tar such as SCT and the hydroprocessing is catalytic hydroprocessing, the molecular hydrogen partial pressure is in a range of from about 34 bar to about 48 bar, such as about 38 bar to about 45 bar, or about 40 bar to 42 bar. The invention is compatible with hydroprocessing at large feed rates, e.g., those where the rate of heavy hydrocarbon flow (or cavitated heavy hydrocarbon flow) to the hydroprocessing reactor is ≥400 kta, e.g., in the range of from about 425 kta to about 650 kta. The hydroprocessing reactor typically has a molecular hydrogen consumption rate ≤2500 SCF/B of heavy hydrocarbon feed (or cavitated heavy hydrocarbon feed) to the hydroprocessor (445 standard cubic meters of molecular hydrogen per cubic meter of tar, "S $m^3/m^3$"), e.g., ≤1500 SCF/B (267 S $m^3/m^3$), such as in the range of from about 600 SCF/B (107 S $m^3/m^3$) to about 1500 SCF/B (267 S $m^3/m^3$). The treat gas typically comprises, e.g., ≥70.0 mole % of molecular hydrogen per mole of the treat gas.

The hydroprocessing is generally operated at a utility fluid: pyrolysis tar weight ratio ≥0.01, e.g., in the range of 0.05 to 4.0, such as in the range of 0.1 to 3.0, or 0.3 to 1.1. Molecular hydrogen is typically supplied to the hydroprocessing stage at a rate about 300 standard cubic feet of molecular hydrogen per barrel ("SCF/B"), where B refers to barrel of raffinate fed to the hydroprocessing stage, to 5000 SCF/B. This corresponds to 53 standard cubic meters of molecular hydrogen per cubic meter of raffinate (S $m^3/m^3$) to 890 S $m^3/m^3$. For example, the molecular hydrogen can be provided in a range of from 1000 SCF/B (178 S $m^3/m^3$) to 3000 SCF/B (534 S $m^3/m^3$). Valve means can be utilized for transferring the desired amounts of pyrolysis tar and utility fluid (or one or more utility fluid components) to the hydroprocessing reactor. It has been found that (i) the coke formed in the hydroprocessing reactor may be at least weakly soluble in the utility fluid; and (ii) the amount of utility fluid may be greater than the amount needed to fully solubilize the SCT in the hydroprocessing reactor.

When the pyrolysis tar comprises SCT, e.g., ≥75.0 wt. %, e.g., ≥90.0 wt. %, such as ≥99.0 wt. % SCT, the amount of utility fluid in the SCT+utility fluid mixture can be, e.g., in the range of from about 5.0 wt. % to about 80.0 wt. %, based on the weight of the SCT+utility fluid mixture, e.g., in the range of from about 40.0 wt. % to about 60.0 wt. %. SCT hydroprocessing conditions can include a reactor temperature in the range of about 300° C. to about 500° C., such as about 350° C. to about 450° C., or about 375° C. to about 425° C., and a hydrogen partial pressure in the range of about 34 bar absolute (500 psig) to about 48 bar absolute (700 psig), e.g., 38 bar (absolute) to 45 bar (absolute). Molecular hydrogen consumption rate is generally ≤267 S $m^3/m^3$, such as in the range of from 107 S $m^3/m^3$ to 214 S $m^3/m^3$.

The hydroprocessing can be catalytic hydroprocessing, carried out in the presence of one or more hydroprocessing catalysts. Conventional hydroprocessing catalyst can be utilized, such as those specified for use in resid and/or heavy oil hydroprocessing, but the invention is not limited thereto. Suitable hydroprocessing catalysts include those comprising (i) one or more bulk metals and/or (ii) one or more metals on a support. The metals can be in elemental form or in the form of a compound. In one or more aspects, the hydroprocessing catalyst includes at least one metal from any of Groups 5 to 10 of the Periodic Table. Examples of such catalytic metals include, but are not limited to, vanadium, chromium, molybdenum, tungsten, manganese, technetium, rhenium, iron, cobalt, nickel, ruthenium, palladium, rhodium, osmium, iridium, platinum, or mixtures thereof. In one or more aspects, the catalyst is a bulk multimetallic hydroprocessing catalyst with or without binder. In one aspect, the catalyst is a bulk trimetallic catalyst comprised of two Group 8 metals, preferably Ni and Co and the one Group 6 metals, preferably Mo. Conventional hydrotreating catalysts can be used, but the invention is not limited thereto. In certain aspects, the catalysts include one or more of KF860 available from Albemarle Catalysts Company LP, Houston Tex.; Nebula™ Catalyst, such as Nebula™ 20, available from the same source; Centera™ catalyst, available from Criterion Catalysts and Technologies, Houston Tex., such as one or more of DC-2618, DN-2630, DC-2635, and DN-3636; Ascent™ Catalyst, available from the same source, such as one or more of DC-2532, DC-2534, and DN-3531; and FCC pre-treat catalyst, such as DN3651 and/or DN3551, available from the same source. However, the invention is not limited to only these catalysts.

The hydroprocessing catalyst can be deployed within the hydroprocessing stage in one or more catalyst beds. Interstage cooling and/or quenching can be used, e.g., using treat gas provided between beds. Alternatively, additional utility fluid can be utilized for cooling and/or quenching, particularly if the SCT+utility fluid mixture is relatively lean in utility fluid.

A raffinate can be produced by removing from the hydroprocessed product (i) at least a portion of any light gases and (ii) at least a portion of any utility fluid boiling-range hydrocarbon. A stream comprising molecular hydrogen can be separated the light gases for recycle to the hydroprocessing. At least a portion of the separated utility fluid boiling-range hydrocarbon can be recycled for use as utility fluid. The raffinate (hydroprocessed heavy hydrocarbon optionally subjected to prior cavitation) typically comprises ≥50 wt. % of the treated product's molecules having an atmospheric boiling point of ≥290° C., e.g., ≥75.0 wt. %, such as ≥90.0 wt. %. In some aspects where cavitation is carried out after hydroprocessing, the entire hydroprocessed product is subjected to cavitation. In other aspects, a portion of the hydroprocessed product's vapor and/or a portion of the hydroprocessed product's liquid are separated from the hydroprocessed liquid before cavitation of the remainder of the hydroprocessed product (the raffinate). For example, the raffinate can be produced by removing from the hydroprocessor effluent (i) at least a portion of any light gases and (ii) at least a portion of any utility fluid boiling-range hydrocarbon. A stream comprising molecular hydrogen can be separated from the light gases for recycle to the hydroprocessing. At least a portion of the separated utility fluid boiling-range hydrocarbon can be recycled for use as utility fluid. The raffinate (a hydroprocessed heavy hydrocarbon) typically comprises ≥50 wt. % of the treated product's molecules having an atmospheric boiling point of ≥290° C., e.g., ≥75.0 wt. %, such as ≥90.0 wt. %. It can be advantageous to cavitate at least a portion of the raffinate instead of the entire hydroprocessor effluent because doing so lessens the amount of vapor entering the cavitation. It also allows the use of cavitation equipment of decreased hydraulic capacity.

Cavitation

Heavy hydrocarbon, e.g., pyrolysis tar, such as SCT and/or hydroprocessed SCT, is subjected to at least one cavitation. The cavitation includes convective acceleration, followed by pressure drop and bubble formation, and then convective deceleration and bubble implosion. The implosion occurs faster than mass in the vapor bubble can transfer to the surrounding liquid, resulting in a near adiabatic collapse. This generates high localized energy densities (temperature, pressure) capable of dealkylation of side chains from large hydrocarbon molecules, cleavage of alkyl linkages between aromatic cores, creating free radicals and other sonochemical reactions. In any aspect, the cavitation unit may receive a continuous flow of the fluid and subject the flow to continuous cavitation within a cavitation region of the unit.

Cavitation is typically carried out by (i) establishing a hydrodynamic flow, e.g., a hydrodynamic flow of SCT and/or hydroprocessed SCT, through a flow-through passage having a portion that ensures the local constriction for the hydrodynamic flow, and (ii) by establishing a hydrodynamic cavitation field (e.g., within a cavitation region of the cavitation unit) of collapsing vapor bubbles in the hydrodynamic field that facilitates the conversion of at least a part of the SCT and/or hydroprocessed SCT, particularly the decomposition of the hydrocarbon components thereof. For example, the SCT and/or hydroprocessed SCT may be conducted to a flow-through passage at a first velocity, and may be accelerated through a continuous flow through passage (such as due to constriction or taper of the passage) to a second velocity that may be 3 to 50 times faster than the first velocity. As a result, in this location the static pressure in the flow decreases, for example to a value in the range of from 1 kPa to 20 kPa. This induces the origin of cavitation in the flow to have the appearance of vapor-filled cavities and bubbles. In the flow-through passage, the pressure of the vapor-phase hydrocarbon inside the cavitation bubbles is in the range of from 1 kPa to 20 kPa. When the cavitation bubbles are carried away in the flow beyond the boundary of the narrowed flow-through passage, the pressure in the fluid increases. This increase in the static pressure drives the near instantaneous adiabatic collapsing of the cavitation bubbles. For example, the bubble collapse time duration may be on the magnitude of $10^{-6}$ to $10^{-8}$ second. The precise duration of the collapse is dependent upon the size of the bubbles and the static pressure of the flow. The flow velocities reached during the collapse of the vacuum may be 100-1000 times faster than the first velocity or 6-100 times faster than the second velocity. In this final stage of bubble collapse, the elevated temperatures in the bubbles are realized with a velocity in the range of $10^{10}$ to $10^{12}$ K/sec. The vaporous/gaseous mixture of hydrocarbons found inside the bubbles may reach temperatures in the range of from 1500° K to 15,000° K at a pressure in the range of from 100 MPa to 1500 MPa. Under these physical conditions inside of the cavitation bubbles, thermal disintegration of hydrocarbon molecules occurs, such that the pressure and the temperature in the bubbles surpasses the magnitude of the analogous parameters of other cracking processes. In addition to the high temperatures formed in the vapor bubble, a thin liquid film surrounding the bubbles is subjected to high temperatures where additional chemistry (i.e., thermal cracking of hydrocarbons and dealkylation of side chains) occurs. The rapid velocities achieved during the implosion generate a shockwave that can mechanically disrupt agglomerates (such as asphaltene agglomerates or agglomerated particulates), create emulsions with small mean droplet diameters, and reduce mean particulate size in a slurry.

Advantageously, in any aspect, a portion of the cavitated product may be divided, e.g., with a portion recycled for use for fluxing the cavitation unit's feed. Fluxing the cavitation unit's feed with cavitated product can be desirable because the cavitation can then be carried out at a lesser temperature, which decreases the amount of asphaltene growth and viscosity reversion that would otherwise occur at a greater cavitation temperature.

The cavitation results in a significant decrease in kinematic viscosity of the cavitated product compared to that of the feed to the cavitation. For example, for a cavitation feed comprising hydroprocessed heavy hydrocarbon such as hydroprocessed SCT, the cavitated product has a kinematic viscosity (measured at 50° C.) of $KV_b$, wherein $KV_b = (x*KV_a)$. $KV_a$ is the kinematic viscosity (measured at 50° C.) of the hydroprocessed heavy hydrocarbon fed to the cavitation, and x is a positive real number that is typically ≤0.95, e.g., ≤0.9, such as ≤0.8, or ≤0.7, or ≤0.6, or ≤0.5, or ≤0.4, or ≤0.3, or ≤0.2, or ≤0.1. The value of x can be, e.g., in the range of from 0.05 to 0.95. For a cavitation feed comprising heavy hydrocarbon that has not been subjected to prior hydroprocessing, such as a non-hydroprocessed SCT, the cavitated product has a kinematic viscosity (measured at 50° C.) of $KV_c$, wherein $KV_c$ is $=(y*KV_i)$. $KV_i$ is the kinematic viscosity (measured at 50° C.) of the non-hydroprocessed heavy hydrocarbon fed to the cavitation, and y is a positive real number that is typically ≤0.95, e.g., ≤0.9, such as ≤0.8, or ≤0.7, or ≤0.6, or ≤0.5, or ≤0.4, or ≤0.3, or ≤0.2, or ≤0.1. The value of y can be, e.g., in the range of from 0.05 to 0.95.

The cavitation can be carried out under conventional conditions, e.g., according to standards provided by manufacturers of hydrodynamic cavitation units. Typically, SCT is supplied to the cavitation stage at a pressure ≥100 psig, e.g., in the range of from about 100 psig to 3000 psig, such as 400 psig to 2500 psig. When the SCT and/or hydroprocessed SCT to be subjected to cavitation is available at lesser pressure, conventional means such as one or more pumps can be used for increasing the pressure of the feed to the cavitation unit into the desired range. It is advantageous to separate any vapor from the SCT and/or hydroprocessed SCT before the cavitation is carried out. Vapor separation can be carried out before or after the pumping.

Typically, the cavitation is carried out at a temperature ≤500° C. but ≥50° C. For example, the cavitation can be carried out at a temperature in the range of about 75° C. to about 350° C., such as in the range of from 90° C. to 250° C., or 95° C. to 200° C., or 100° C. to 200° C. The pressure drop across the cavitation unit is typically ≥400 psig, e.g., ≥1000 psig, such as ≥2000 psig. In particular for SCT or hydroprocessed SCT, the cavitation can be conducted at a temperature ≤200° C., e.g., <150° C., such as in the range of 50° C. to 200° C., or 75° C. to 150° C. It is observed that when cavitation is performed at a relatively low temperature, e.g., <150° C., a greater improvement in $I_N$ is achieved in the cavitated product, particularly when cavitating a pyrolysis tar that has not been subjected to prior hydroprocessing, such as a non-hydroprocessed SCT.

When the feed to the cavitation unit is available at a greater temperature than is desired, cooling means such as one or more indirect heat transfers can be used for cooling the cavitation feed or one or more cavitation feed components. For example, when the cavitation feed comprises hydroprocessed SCT at a temperature in the range of about 300° C. to about 500° C. (representative of certain SCT hydroprocessor effluent temperatures) the cavitation feed can be cooled by indirectly transferring heat to the hydroprocessor feed. This desirably lessens the need for fired heaters (or other SCT pre-heating) upstream of the hydroprocessor.

The cavitation can be carried out before hydroprocessing, after hydroprocessing, or before and after hydroprocessing. In certain aspects, a SCT is subjected to cavitation before hydroprocessing. The SCT is first conducted to a cavitation stage to convert at least a portion of the hydrocarbons present in the SCT to lower molecular weight hydrocarbons. The cavitated SCT is then combined with utility fluid and treat gas. The mixture of treat gas+utility fluid+cavitated SCT is subjected to catalytic SCT hydroprocessing.

Inter-stage Separation

Inter-stage separation can be utilized between cavitation and hydroprocessing stages. In aspects where at least one hydroprocessing stage is located upstream of a cavitation stage, the hydroprocessed product or cooled hydroprocessed product can be conducted to a separation stage for separating from the hydroprocessed product at least (i) a vapor-phase mixture (e.g., heteroatom vapor, vapor-phase cracked products, unused treat gas, etc.) and a liquid-phase mixture comprising hydroprocessed SCT and utility-fluid boiling-range hydrocarbon. The utility fluid boiling-range hydrocarbon can be separated from the liquid-phase mixture for re-use in producing the SCT+utility fluid mixture. Unused treat gas can be separated from the vapor-phase mixture for re-use in the hydroprocessing. Supplemental treat gas and/or supplemental utility fluid can be added if needed, e.g., during start-up before sufficient material is available for separation from the hydroprocessed product.

The vapor-phase mixture separated from the hydroprocessed product can be upgraded before treat gas recycle/re-use. For example, the vapor phase mixture can be conducted to one or more amine towers for acidic gas removal. Fresh amine is conducted to the upgrading stage, while rich amine is conducted away. Upgraded treat gas is conducted away from the upgrading stage, compressed in a compressor, and conducted for re-cycle and re-use in the hydroprocessing stage.

Treated Product

A treated product is obtained from the hydroprocessed, cavitated heavy hydrocarbon, the hydroprocessing and cavitation being carried out in any order. The treated product typically has at least one of the following properties: (i) a lower kinematic viscosity, (ii) a lower sulfur content, (iii) lower mass density, and (iv) a lower insolubility number ($I_N$), compared to the heavy hydrocarbon feed prior to treatment by the hydroprocessing and cavitation described herein, particularly heavy hydrocarbon feeds comprising pyrolysis tar such as SCT. The treated product is of sufficient quality to be a compatible fuel oil blending component.

Significant improvements in one or more of kinematic viscosity, sulfur content, mass density, and $I_N$, are observed in the treated product over those of the heavy hydrocarbon feed. These benefits are achieved even when operating the hydroprocessing at a molecular hydrogen partial pressure of <68 bar, e.g., ≤60 bar, such as ≤50 bar, or even ≤45 bar. In certain aspects, the kinematic viscosity of the treated product, $KV_t$, has a value of $z*KV_i$, where $KV_i$ is the kinematic viscosity of the heavy hydrocarbon feed and z is ≤0.99, e.g., ≤0.95, such as ≤0.90, or ≤0.80, or ≤0.70, or ≤0.60, or ≤0.50, or ≤0.40, or ≤0.30, or ≤0.20, or ≤0.10. The value of z can be, e.g., in the range of from 0.05 to 0.99, such as 0.1 to 0.90. In certain aspects, the sulfur content of the treated product $S_t$ is $\leq h*S_i$, where $S_i$ is the sulfur content of the heavy hydrocarbon and h is a real number that is ≤0.6, e.g., ≤0.5, such as ≤0.4, or ≤0.3, or ≤0.2, or ≤0.1, or ≤0.05. The value of h can be, e.g., in the range of from 0.01 to 0.55, such as 0.05 to 0.5. In certain aspects, the mass density of the treated product $\rho_t$ is $f*\rho_i$, where $\rho_i$ is the mass density of the heavy hydrocarbon and f is a positive real number ≤0.99, e.g., ≤0.98, such as ≤0.95, or ≤0.90. For example, the value off can be in the range of from 0.5 to 0.99, such as 0.75 to 0.98. In certain aspects, the insolubility number of the treated product $(I_N)_t$ is equal to $b*(I_N)_i$, where $(I_N)_i$ is the insolubility number of the heavy hydrocarbon and b is a positive real number ≤0.95, e.g., ≤0.9, such as ≤0.8, or ≤0.7, or ≤0.6, or ≤0.5, or ≤0.4. The value of b can be, e.g., in the range of from 0.1 to 0.95, such as 0.5 to 0.9.

For example, when the heavy hydrocarbon feed comprises ≥90.0 wt. % of SCT having one or more of a mass density ≥1.0 kg/m$^2$, e.g., in the range of from 1.10 kg/m$^2$ to 1.20 kg/m$^2$, a sulfur content ≥0.25 wt. %, e.g., in the range of from 0.5 wt. % to 5 wt. %; and a kinematic viscosity (measured at 50° C.) ≥500 cSt, e.g., in the range of from 1000 cSt to 500,000 cSt; the treated product is observed to have one or more of a sulfur content ≤1.0 wt. %, a kinematic viscosity (measured at 50° C.) ≤30 cSt, and a mass density ≤1.1 kg/m$^2$, and an $I_N \leq 80$.

Blending

The treated product is compatible for blending with heavy oils, such as heavy fuel oils, without appreciable asphaltene precipitation. For example, the treated product is compatible for blending with residual fuel oil, such as No. 5 and No. 6 fuel oils, Residual fuel oils include those fuel oil that remain after distillate fuel oils and lighter hydrocarbons are separated and conducted away, e.g., in one or more refinery operations. Such residual fuel oils typically conform to A.S.T.M. Specifications D 396 and D 975 and Federal Specification VV-F-815C. No. 5, a residual fuel oil of medium viscosity, is also known as Navy Special and is defined in Military Specification MIL-F-859E, including Amendment 2 (NATO Symbol F-770). No. 5 residual fuel oil is typically used in steam-powered vessels and on-shore power plants. No. 6 fuel oil includes Bunker C fuel oil, and is typically used for the production of electric power, space heating, vessel bunkering, and various industrial purposes. In particular, the treated product is compatible for blending with residual marine fuel oils identified as RMA 10, RMB 30, RMD 80, RME 180, RMG 380, RMG 500, RMG 700, RMK 380, RMK 500, and RMK 700.

Systems for Treating a Hydrocarbon Feed

Certain aspects of the invention relate to systems for treating a heavy hydrocarbon feed. Such as system can comprise, e.g., (a) a hydroprocessing unit operated at a temperature in the range of about 300° C. to about 500° C. in the presence of (i) a treat gas and (ii) a utility fluid under catalytic hydroprocessing conditions at a utility fluid: tar weight ratio in the range of 0.05 to 4.0, wherein the treat gas is provided with a hydrogen partial pressure of about 500 psig (34 bar) to about 700 psig (48 bar); and (b) a cavitation unit operated at a temperature ≤200° C. to convert at least a portion of the hydrocarbons present in the cavitation unit's feed to lower molecular weight hydrocarbons; wherein the product generated after hydroprocessing and hydrodynamic cavitation has at least one of the following properties: (i) a lower viscosity, (ii) a lower sulfur content, and (iii) a lower insolubility number ($I_N$), compared to the hydrocarbon feed.

The hydrodynamic cavitation unit can be deployed downstream or upstream of the hydroprocessing unit. For certain heavy hydrocarbons processed to produce a treated product used for blending with residual fuel oil, it can be advantageous to locate the cavitation unit downstream of the hydroprocessing unit. It is observed that doing so decreases the rate at which hydroprocessing reactor pressure drop increases. The pressure drop increase mainly results, it is believed, from TH (e.g., asphaltene) precipitation in the hydroprocessing reactor. While not wishing to be bound by any theory or model, it is believed that operating the cavitation unit (i) upstream of the hydroprocessing unit and (ii) under relatively severe cavitation conditions can result in a cavitation product having an $S_{BN}$ value that is less than that of the feed to the cavitation unit. Utilizing hydroprocessor feeds of lesser $S_{BN}$ values is observed to detrimentally increase the rate at which hydroprocessor reactor pressure drop increases. Lesser $S_{BN}$ values are believed to result from a significant increase in saturates and 1-ring aromatics produced in by relatively severe cavitation. In order to overcome this difficulty, a cavitation unit located upstream of a hydroprocessing unit is typically operated under less severe cavitation conditions, e.g., a pressure drop across the cavitation unit ≤1000 psig, such as ≤750 psig, and a cavitation temperature ≤200° C., e.g., <150° C., such as in the range of 50° C. to 200° C., or 75° C. to 150° C. In aspects where a cavitation unit is located upstream of the hydroprocessing unit, the cavitation is implemented before the cavitated product is mixed with the treat gas. It is observed that cavitation is more effective when the cavitation unit operates on a liquid-phase feed, rather than a feed comprising liquid and vapor phases. Combining cavitated product with treat gas before hydroprocessing is observed to beneficially hydrogenate any persistent radicals in the cavitation product.

Figure 3A:
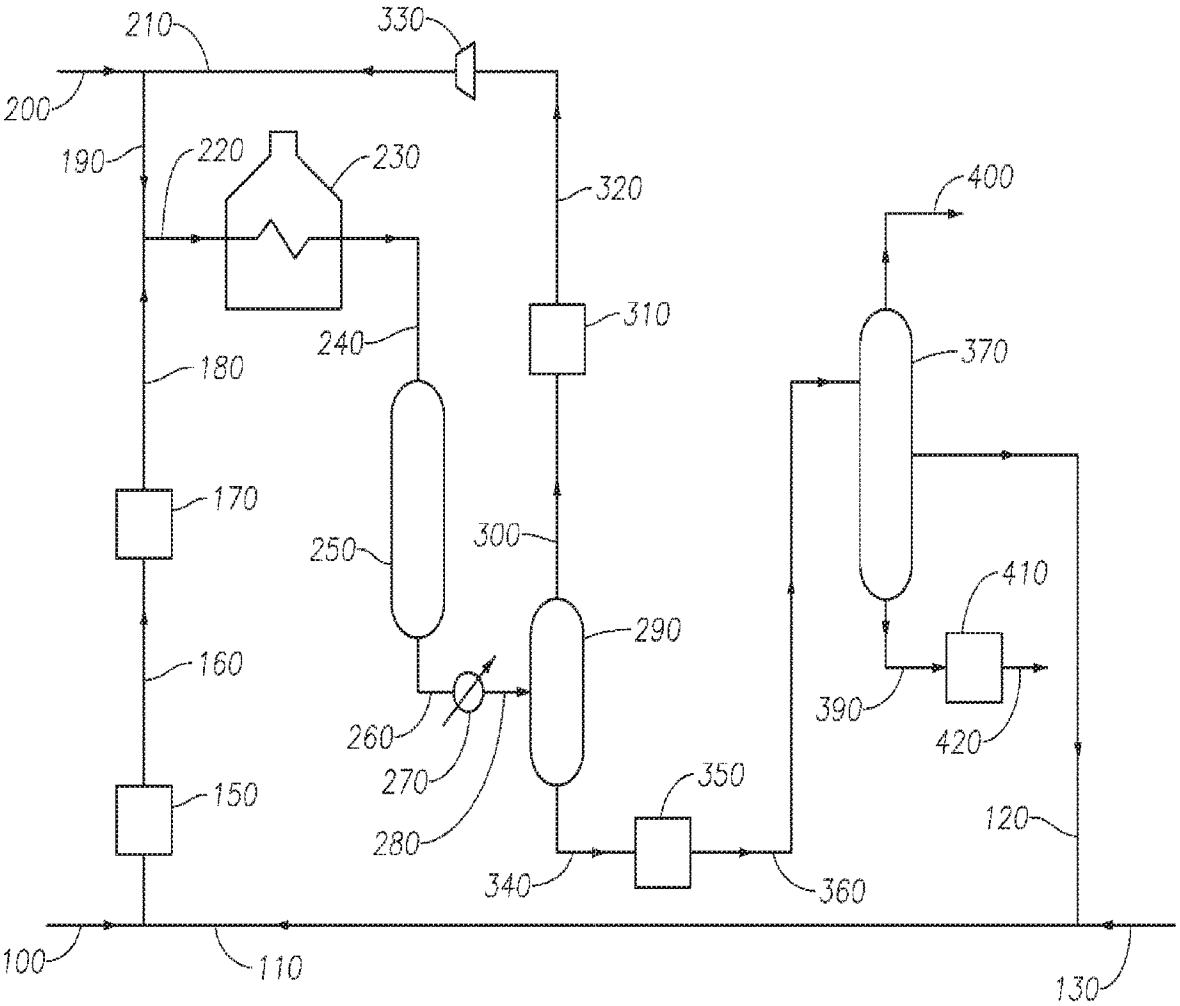
FIG. 3A schematically depicts certain aspects of the invention where cavitation is utilized in combination with hydroprocessing to produce a treated product. In these aspects, liquid and vapor phases are separated from the hydroprocessed product. The treated product and a utility fluid boiling-range hydrocarbon are obtained from the separated liquid phase.
Figure 3B:
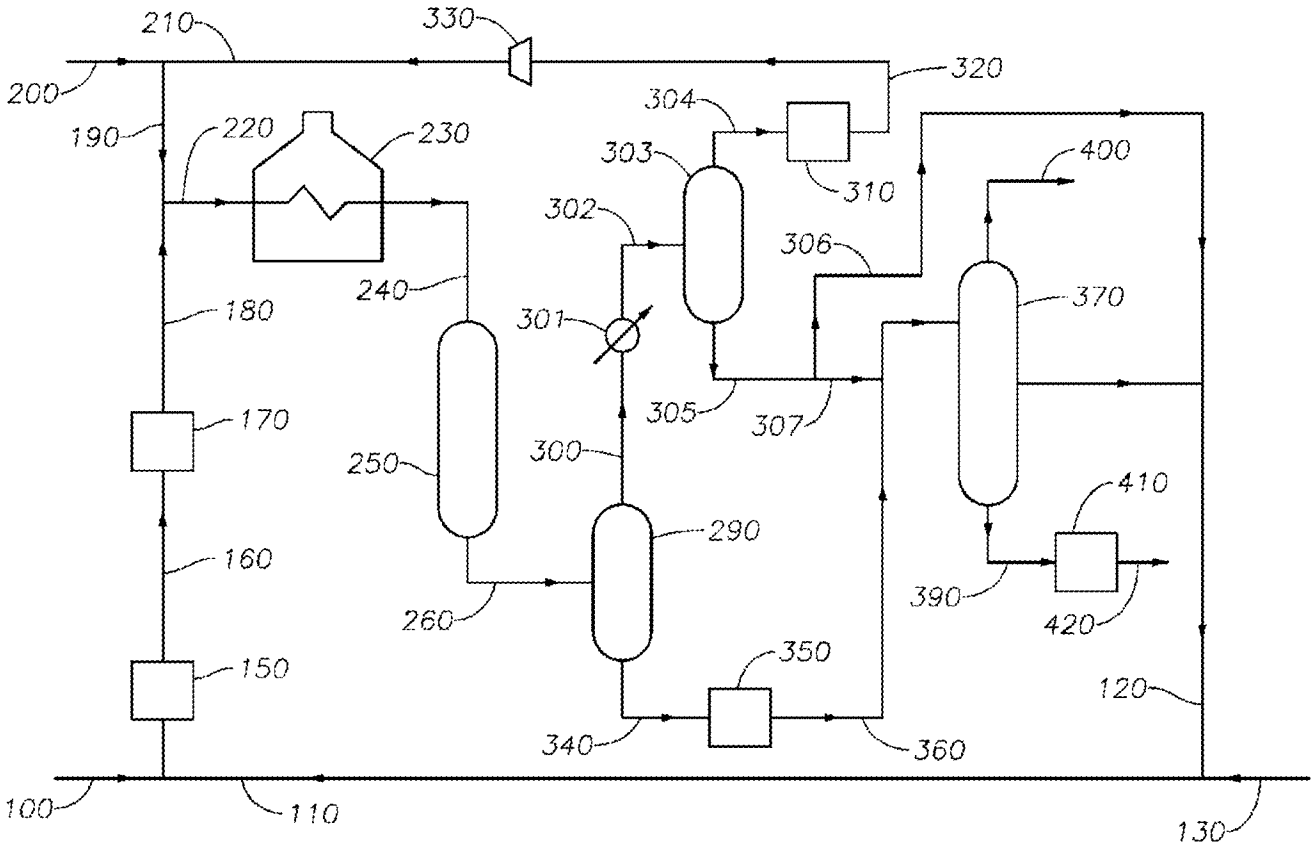
FIG. 3B schematically depicts certain aspects of the invention where cavitation is utilized in combination with hydroprocessing to produce a treated product. In these aspects, liquid and vapor phases are separated from the hydroprocessed product. At least a portion of the utility fluid boiling-range hydrocarbon is obtained from the separated vapor phase.

Exemplary configurations for the system in accordance with the invention are illustrated in FIGS. 3*a* and 3*b*, where the same reference numbers are used to identify components of similar or identical function.

In the aspects illustrated in FIG. 3*a*, liquid and vapor phases are separated from the hydroprocessed product. The treated product and a utility fluid boiling-range hydrocarbon are obtained from the separated liquid phase. The heavy hydrocarbon feed 100 (e.g., a pyrolysis tar or cavitated pyrolysis tar) is combined with utility fluid 100. The heavy hydrocarbon+utility fluid mixture is then combined with treat gas 190 to produce a hydroprocessor feed mixture 220. Optional stages for cavitation 170 and/or filtration 150 of the heavy hydrocarbon+utility fluid mixture can be located upstream of the treat gas addition. The hydroprocessor feed mixture is preheated in stage 230, typically to a temperature ≥300° C., e.g., in the range of 300° C. to 500° C. The preheated hydroprocessor feed mixture is conducted via line 240 to hydroprocessing reactor 250. Hydroprocessed product 260 is optionally conducted for cooling in stage 270 and then via line 280 to liquid-vapor separator 290. A vapor phase separated from the hydroprocessed product is conducted via line 300 to treat gas upgrading stage 310 for removal of at least apportion of any heteroatom gases. The upgraded treat gas is then conducted via line 320 to compressor 330 and recycled via line 210 to line 190. Treat gas make-up can be provided as needed via line 200. A liquid-phase portion of the hydroprocessed product is conducted away from liquid-vapor separator 290 via line 340 to cavitation unit 350. Hydroprocessed, cavitated product is conducted via line 360 to separation stage 370 for (i) removal via line 400 of at least a portion of any vapor phase present in the hydroprocessed, cavitated product, (ii) for removal vial line 120 of a utility fluid boiling-range hydrocarbon, and (iii) for removal via line 390 of separator bottoms. Make-up (e.g., supplemental) utility fluid can be provided via line 130 if needed. The separator bottoms can be conducted away as treated product via line 420, optionally after a second cavitation in stage 410.

In the aspects illustrated in FIG. 3*b*, liquid and vapor phases are separated from the hydroprocessed product. At least a portion of the utility fluid boiling-range hydrocarbon is obtained from the separated vapor phase. As in the aspects illustrated in FIG. 3*a*, heavy hydrocarbon feed 100 (e.g., a pyrolysis tar or cavitated pyrolysis tar) is combined with utility fluid 100. The heavy hydrocarbon+utility fluid mixture is then combined with treat gas 190 to produce a hydroprocessor feed mixture 220. Optional stages for cavitation 170 and/or filtration 150 of the heavy hydrocarbon+utility fluid mixture can be located upstream of the treat gas addition. The hydroprocessor feed mixture is preheated in stage 230, and the preheated hydroprocessor feed mixture 240 is conducted to hydroprocessing reactor 250. Hydroprocessed product 260 is optionally conducted for cooling in stage 270 and then via line 280 to liquid-vapor separator 290. A vapor phase separated from the hydroprocessed product is conducted via line 300 to cooling stage 301 for condensing at least a portion of the vapor into the liquid phase. The liquid and vapor are conducted via line 302 to vapor-liquid separator 303 for separating a vapor-phase overhead stream 304 and a liquid-phase bottoms stream 305. The overhead stream is conducted to treat gas upgrading stage 310 for removal of at least apportion of any heteroatom gases. The upgraded treat gas is then conducted via line 320 to compressor 330 and recycled via line 210 to line 190. Treat gas make-up can be provided as needed via line 200. A liquid-phase portion of the hydroprocessed product is conducted away from liquid-vapor separator 290 via line 340 to cavitation unit 350. Hydroprocessed, cavitated product is conducted via line 360 to separation stage 370 for (i) removal via line 400 of at least a portion of any vapor phase present in the hydroprocessed, cavitated product, (ii) for removal vial line 120 of a utility fluid boiling-range hydrocarbon, and (iii) for removal via line 390 of separator bottoms. The bottoms stream from separator stage 303 is combined with the utility fluid boiling-range hydrocarbon of line 120. Make-up (e.g., supplemental) utility fluid can be provided via line 130 if needed. The separator bottoms can be conducted away as treated product via line 420, optionally after a second cavitation in stage 410.

In alternative aspects, not shown, cavitation unit 170 is utilized instead of cavitation units 350 and 410. In other alternative aspects, not shown, cavitation unit 410 is utilized instead of cavitation units 170 and 350. The cavitation units, the hydroprocessor, the separation stages, treat gas upgrading stages, etc. can be operated using the conditions specified for the preceding aspects. The heavy hydrocarbon feed and the treated product can be the same as those described in the preceding aspects. In other alternative aspects, not shown, valve means are utilized to adjust the relative amounts of utility fluid boiling-range hydrocarbon obtained from stages 303 and 370 that is conducted to line 110.

The cavitation units, the hydroprocessor, the separation stages, treat gas upgrading stages, etc. can be operated using the conditions specified for the preceding aspects. The heavy hydrocarbon feed and the treated product can be the same as those described in the preceding aspects.

Those skilled in the art of hydrocarbon processing will appreciate that when the heavy hydrocarbon comprises pyrolysis tar such as SCT, the utility fluid boiling-range hydrocarbon of lines 120 and 320 can be configured to comprise ≥25.0 wt. % of 1-ring and 2-ring aromatics, based on the weight of the side stream, such as ≥50.0 wt. % of 1-ring and 2-ring aromatics. The utility fluid of line 110 typically comprises ≥50.0 wt. % of the contents of line 120 (in the aspects of FIG. 3*a*) or the combined contents of lines 306 and 120 (in the aspects of FIG. 3*b*), e.g., ≥75.0 wt. %, such as ≥90.0 wt. %, or substantially all of the contents of these streams. Any of the utility fluid boiling-range hydrocarbon that is not needed for use in the hydroprocessing can be conducted away for storage or further processing. When the heavy hydrocarbon comprises pyrolysis tar such as SCT, the utility fluid boiling-range hydrocarbon of lines 120 and 306 typically have a 10% (weight basis) true boiling point ≥175.0° C. and a 90% (weight basis) true boiling point ≤400.0° C.

Hydroprocessing run-lengths are generally ≥one month ($2.67\times10^6$ seconds), e.g., ≥six months ($1.6\times10^7$ seconds), such as ≥one year ($3.2\times10^7$ seconds), or even ≥three years ($9.6\times10^7$ seconds). The pressure drop across the hydroprocessing stage is the primary factor in hydroprocessing run-length, with hydroprocessing run-length being defined as the duration of time on-stream during which the pressure drop across the hydroprocessing stage increases from an initial value at start-up to a value that is two times the initial value or more, e.g., three times the initial value or more. This increased run-length benefit can be obtained over a wide range of molecular hydrogen partial pressure.

EXAMPLES

A mixture of utility fluid and SCT is hydroprocessed under conditions that are substantially the same as those disclosed in WO2013/033590 A1. It is observed that when operating the SCT hydroprocessing under the specified conditions at a molecular hydrogen partial pressure of approximately 68 bar, the hydroprocessed SCT has a kinematic viscosity (measured at 50° C.) of 10 cSt, an $I_N$ of 63, and a sulfur content of 0.78 wt. %. Asphaltene precipitation is not observed when blending the hydroprocessed SCT with a conventional residual fuel oil (grade RMA10) having a solubility blend number ("$S_{bn}$") of 89, a kinematic viscosity (measured at 50° C.) of 10 cSt, and a sulfur content of 3.5 wt. % based on the weight of the fuel oil.

While keeping other conditions substantially constant (e.g., temperature, utility fluid: SCT mass ratio, etc.), the molecular hydrogen partial pressure is decreased from about 68 bar to about 40 bar. It is observed that the hydroprocessed SCT obtained when hydroprocessing at a molecular hydrogen partial pressure of 40 bar is substantially inferior product compared to one produced at a molecular hydrogen partial pressure of 68 bar. In particular, it is observed that when hydroprocessing at a molecular hydrogen partial pressure of 40 bar, the hydroprocessed SCT obtained has a kinematic viscosity (measured at 50° C.) of 24 cSt and an $I_N$ of approximately 85. The hydroprocessed SCT also has a greater sulfur content, as shown in FIG. 1*b*. Asphaltene precipitation is observed when the hydroprocessed SCT is blended with the fuel oil, which is an indication that the SCT and fuel oil are incompatible.

Figure 2A:
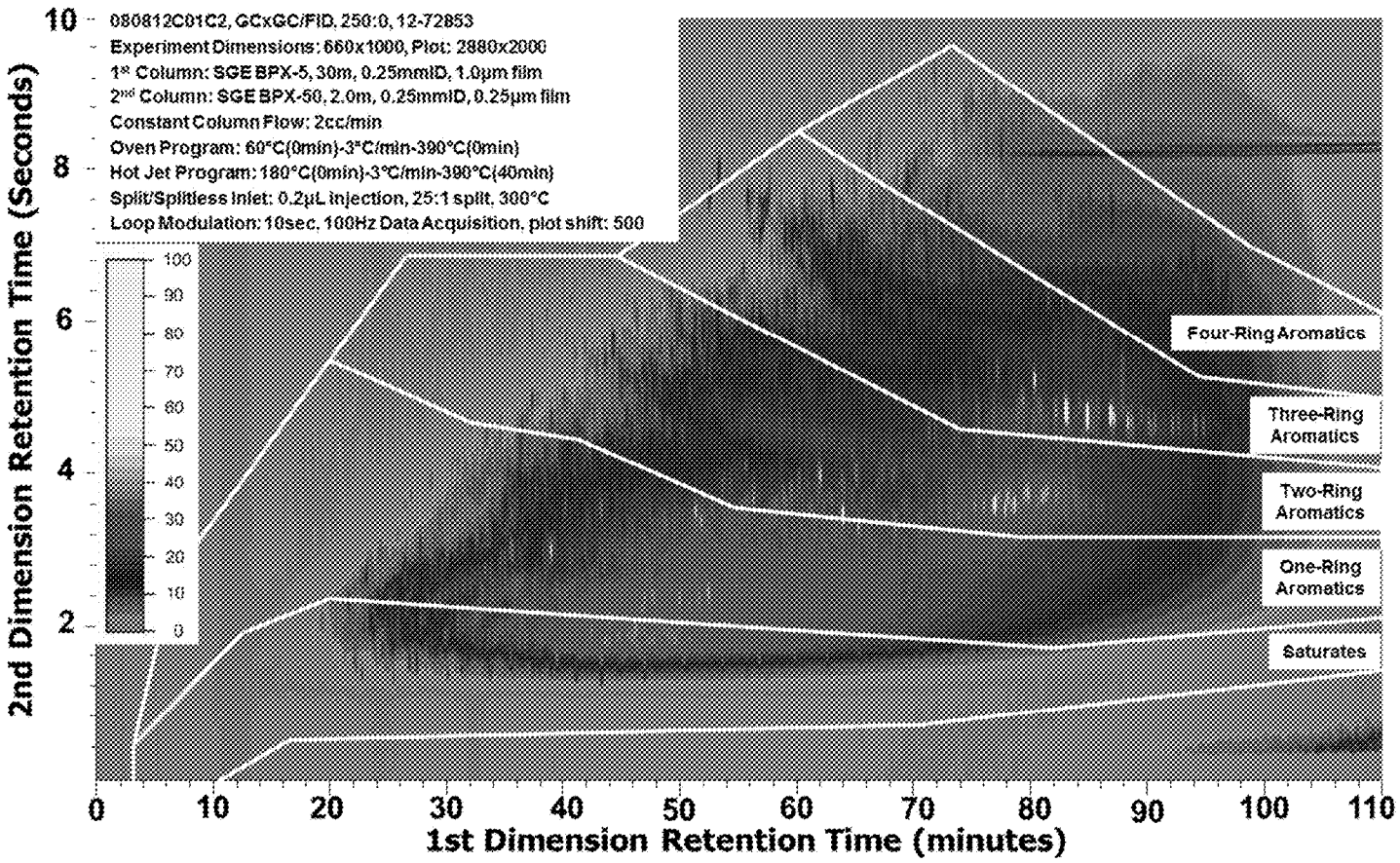
FIG. 2*a* depicts two-dimensional gas chromatography (2D-GC) results for a representative heavy hydrocarbon (bitumen).
Figure 2B:
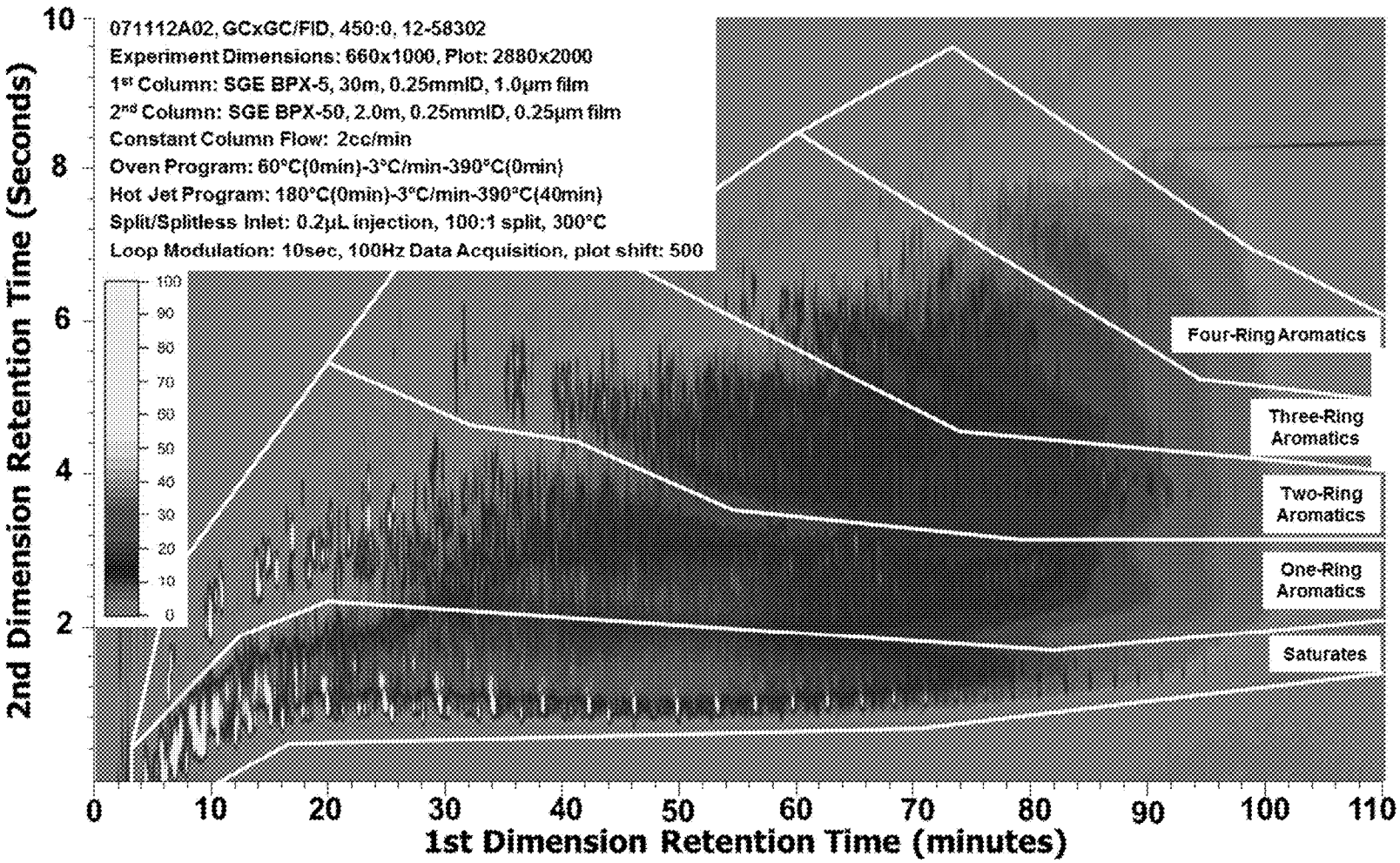
FIG. 2*b* shows the formation of saturates and 1-ring aromatics from 3- and 4-ring species when the heavy hydrocarbon is exposed to cavitation.

In order to show the benefits of cavitation for kinematic viscosity reduction, two representative heavy hydrocarbons (vacuum resid and bitumen) are subjected to visbreaking. The same heavy hydrocarbons are then subjected to cavitation. As shown in the Table, the product kinematic viscosity is much less for cavitated vacuum resid and cavitated bitumen than is achieved by visbreaking these feeds. The tabulated results also show that cavitation of vacuum resid results in the conversion of molecules in the vacuum resid having an atmospheric boiling point ≥606° C. to product molecules of lesser atmospheric boiling point. The amount of this desirable conversion is greater in cavitation than in the visbreaking of the same resid in a visbreaker operating at 60 equivalent seconds and is nearly as great as in a visbreaker operating at 130 equivalent seconds. Results are even better when the cavitation is carried out on bitumen. In that case, the conversion resulting from cavitation is more than twice that of a visbreaker operating at 130 equivalent seconds. Further evidence of this effect is show in FIG. 2*a* depicts two-dimensional gas chromatography (2D-GC) results for bitumen. FIG. 2*b* is a 2D-GC plot showing the formation of saturates and 1-ring aromatics from 3- and 4-ring species when the bitumen is exposed to cavitation.

TABLE

Improvement by Cavitation of Vacuum Resid and Bitumen in Comparison with Visbreaking

| | Vacuum Resid | | | Bitumen | | |
|---|---|---|---|---|---|---|
| Visbreaker Severity, eq. sec | 60 | 130 | Cavitation | 60 | 130 | Cavitation |
| 1050° F. (606° C.) + Conversion, wt. % | 19.9 | 29.7 | 25.7 | 1.1 | 16 | 34 |
| Product Viscosity @ 100° C., cSt | 170 | 102.5 | 43.97 | 32.4 | 21.4 | 10.2 |

All patents, test procedures, and other documents cited herein are fully incorporated by reference to the extent such disclosure is not inconsistent and for all jurisdictions in which such incorporation is permitted. When numerical lower limits and numerical upper limits are listed herein, ranges from any lower limit to any upper limit are contemplated. While the illustrative forms disclosed herein have been described with particularity, it will be understood that various other modifications will be apparent to and can be readily made by those skilled in the art without departing from the spirit and scope of the disclosure. Accordingly, it is not intended that the scope of the claims appended hereto be limited to the example and descriptions set forth herein, but rather that the claims be construed as encompassing all the features of patentable novelty which reside herein, including all features which would be treated as equivalents thereof by those skilled in the art to which this disclosure pertains.

What is claimed is:

1. A heavy hydrocarbon treatment method, comprising:

(a) providing a heavy hydrocarbon having a mass density (measured at 15° C.) ≥1.0 g/cm$^3$ and a kinematic viscosity (measured at 50° C.) $KV_i$≥30 cSt;

(b) cavitating the heavy hydrocarbon to produce a cavitated heavy hydrocarbon having a kinematic viscosity (measured at 50° C.) of $KV_c$, wherein (i) $KV_c$ is $=(y*KV_i)$ and (ii) y is ≤0.95 and wherein cavitation is conducted at a temperature between 50° C. and 200° C.; and (c) hydroprocessing at least a portion of the cavitated heavy hydrocarbon to produce a treated product.

2. The method of claim 1, further comprising:

(d) providing a utility fluid which (i) comprises 1-ring and/or 2-ring aromatics in an amount ≥25.0 wt. % and (ii) has a final boiling point ≤430° C.; and (e) combining the utility fluid with the heavy hydrocarbon and/or cavitated heavy hydrocarbon before the hydroprocessing.

3. The method of claim 1, further comprising cavitating at least a portion of the hydroprocessed product.

4. The method of claim 1, wherein the heavy hydrocarbon comprises ≥90.0 wt. % of steam cracker tar, the steam cracker tar having one or more of (i) an $I_N$≥85, (ii) a mass density (measured at 15° C.) ≥1.07 g/cm$^3$, and (iii) a viscosity in the range of from 1000 cSt to 500,000 cSt.

5. The method of claim 1, wherein y is ≤0.7.

6. The method of claim 1, wherein y is ≤0.5.

7. The method of claim 1, wherein the hydroprocessing is catalytic hydroprocessing and the hydroprocessing conditions include a temperature in the range of 300° C. to 500° C., a molecular hydrogen consumption rate ≤267 standard m$^3$ of molecular hydrogen per m$^3$ of the heavy hydrocarbon, and a molecular hydrogen partial pressure in the range of from 34 bar (abs) to 48 bar (abs).

8. The method of claim 1, further comprising: producing a raffinate by separating from the hydroprocessed product one or more of (i) at least a portion of any vapor present in the hydroprocessed product and recycling at least a portion of the separated vapor to the hydroprocessing and (ii) separating from the hydroprocessed product at least a portion of those components having an atmospheric boiling point ≤430° C., wherein the utility fluid comprises at least a portion of the separated components of the hydroprocessed product.

9. The method of claim 8 wherein the raffinate comprises ≥90 wt. % of the hydroprocessed product's molecules having an atmospheric boiling point ≥290° C., and wherein the raffinate has one or more of (i) a kinematic viscosity (measured at 50° C.) <30 cSt, (ii) an $I_N \leq 80$, (iii) a sulfur content ≤1.0 wt. %, and (iv) a mass density (measured at 15° C.) ≤1.1 g/cm$^3$.

* * * * *